US011439206B2

(12) United States Patent
Santos

(10) Patent No.: US 11,439,206 B2
(45) Date of Patent: Sep. 13, 2022

(54) METHOD OF MAKING AN ARTICLE OF FOOTWEAR WITH BRAIDED UPPER

(71) Applicant: Under Armour, Inc., Baltimore, MD (US)

(72) Inventor: Craig Santos, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 264 days.

(21) Appl. No.: 16/716,661

(22) Filed: Dec. 17, 2019

(65) Prior Publication Data

US 2021/0177102 A1 Jun. 17, 2021

(51) Int. Cl.
*A43D 25/20* (2006.01)
*D04C 1/06* (2006.01)

(52) U.S. Cl.
CPC ..... *A43D 25/20* (2013.01); *D04C 1/06* (2013.01); *D10B 2501/043* (2013.01)

(58) Field of Classification Search
CPC ..... A43B 9/12; A43B 13/38; A43B 23/042; A43B 23/045; A43B 1/04; A43D 25/06; D04C 3/02
See application file for complete search history.

(56) References Cited

U.S. PATENT DOCUMENTS 5,257,571 A 11/1993 Richardson
6,931,762 B1 8/2005 Dua
7,908,956 B2 3/2011 Dow et al.
10,674,791 B2 * 6/2020 Bruce ..... A43B 23/042
2006/0283042 A1 12/2006 Greene et al.
2013/0139409 A1 6/2013 Chang et al.
2014/0283411 A1 9/2014 Nabernik
2014/0373389 A1 * 12/2014 Bruce ..... A43B 23/042 36/87
2015/0096199 A1 * 4/2015 Cavaliere ..... A43C 15/16 36/103
2016/0166000 A1 * 6/2016 Bruce ..... A43B 1/04 12/142 G
2016/0166007 A1 * 6/2016 Bruce ..... D04C 3/48 36/31
2016/0166011 A1 * 6/2016 Bruce ..... A43D 1/025 12/51
2016/0345674 A1 * 12/2016 Bruce ..... D04C 1/06
2016/0345676 A1 * 12/2016 Bruce ..... A43B 23/0245
2016/0345677 A1 * 12/2016 Bruce ..... D04C 3/48
2017/0035149 A1 * 2/2017 Bruce ..... D04C 1/08
2017/0055632 A1 * 3/2017 Cavaliere ..... A43B 13/141
2018/0014609 A1 * 1/2018 Bruce ..... A43B 23/0205
2018/0153265 A1 * 6/2018 Jeandin ..... B29D 35/126
(Continued)

OTHER PUBLICATIONS

Non-Final Office Action dated Sep. 7, 2021 for U.S. Appl. No. 16/716,671.

*Primary Examiner* — Shaun R Hurley
*Assistant Examiner* — Bao-Thieu L Nguyen
(74) *Attorney, Agent, or Firm* — Maginot, Moore & Beck LLP

(57) ABSTRACT

A method of making an article of footwear with a braided upper is disclosed. The method includes overbraiding a last to form a braided upper and cutting a bottom opening in the braided upper to remove the last. The bottom opening is cut so as to leave a bottom peripheral portion on the bottom side of the braided upper. A midsole is attached directly to the bottom peripheral portion using a bonding agent.

20 Claims, 20 Drawing Sheets

(56) References Cited

U.S. PATENT DOCUMENTS

| | | | | |
|---|---|---|---|---|
| 2018/0168274 | A1 | 6/2018 | Dickson | |
| 2018/0343957 | A1* | 12/2018 | Bruce | A43B 23/0205 |
| 2018/0343958 | A1* | 12/2018 | Bruce | A43D 8/08 |
| 2018/0343960 | A1* | 12/2018 | Bruce | D04C 3/48 |
| 2018/0343961 | A1* | 12/2018 | Bruce | A43B 13/223 |
| 2018/0343962 | A1* | 12/2018 | Bruce | A43B 1/04 |
| 2018/0368506 | A1* | 12/2018 | Bruce | A43D 3/022 |
| 2018/0368510 | A1* | 12/2018 | O'Haire | A43B 23/0275 |
| 2019/0014854 | A1* | 1/2019 | Santos | D04C 3/22 |
| 2019/0216174 | A1* | 7/2019 | O'Haire | D04C 3/40 |
| 2019/0231031 | A1* | 8/2019 | Bruce | D04C 3/48 |
| 2020/0100555 | A1* | 4/2020 | Santos | A43B 13/127 |
| 2020/0281325 | A1* | 9/2020 | Marvin | A43D 86/00 |
| 2021/0040658 | A1* | 2/2021 | Bruce | D04C 3/48 |
| 2021/0177095 | A1* | 6/2021 | Santos | A43B 23/0255 |
| 2021/0177102 | A1* | 6/2021 | Santos | A43B 13/38 |
| 2021/0219659 | A1* | 7/2021 | Ventenat | A43B 23/042 |
| 2021/0235807 | A1* | 8/2021 | Casillas | A43B 1/04 |
| 2021/0282501 | A1* | 9/2021 | Lind | A43B 23/0235 |
| 2021/0315324 | A1* | 10/2021 | Iwashita | A43D 25/183 |

* cited by examiner

METHOD OF MAKING AN ARTICLE OF FOOTWEAR WITH BRAIDED UPPER

BACKGROUND

The present embodiments relate generally to articles of footwear, and in particular to articles of footwear with braided components.

Braided articles can be formed by overbraiding strands of material onto a form, such as shoe last. The resulting braided articles may be lightweight and durable. However, during the braiding process the form may be enclosed within the overbraided structure, making it difficult to remove the form. Additionally, if the resulting overbraided structure is relatively stiff, it may be difficult to apply conventional methods for securing the overbraided structure to another component, like a sole structure.

SUMMARY

In one aspect, a method of making a braided upper includes passing a last through a braiding machine to form a braided upper that encloses the last and removing a bottom portion of the braided upper to form a bottom opening, where a portion of the last is exposed through the bottom opening. The method also includes passing the last through the bottom opening to remove the last from an interior cavity of the braided upper.

In another aspect, a method of making an article of footwear includes passing a last through a braiding machine to form a braided upper that encloses the last. The method also includes removing a bottom portion of the braided upper to form a bottom opening, where a portion of the last is exposed through the bottom opening, and where the braided upper includes a bottom peripheral portion extending around the bottom opening. The method also includes passing the last through the bottom opening to remove the last from an interior cavity of the braided upper and associating a midsole with the braided upper, where the midsole has an upper surface. The method also includes bonding the bottom peripheral portion to the upper surface of the midsole.

In another aspect, a method of making a braided upper includes steps of passing a last through a braiding machine to form a braided upper that encloses the last, removing a bottom portion of the braided upper to form a bottom opening, where a portion of the last is exposed through the bottom opening, and passing the last through the bottom opening to remove the last from an interior cavity of the braided upper.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
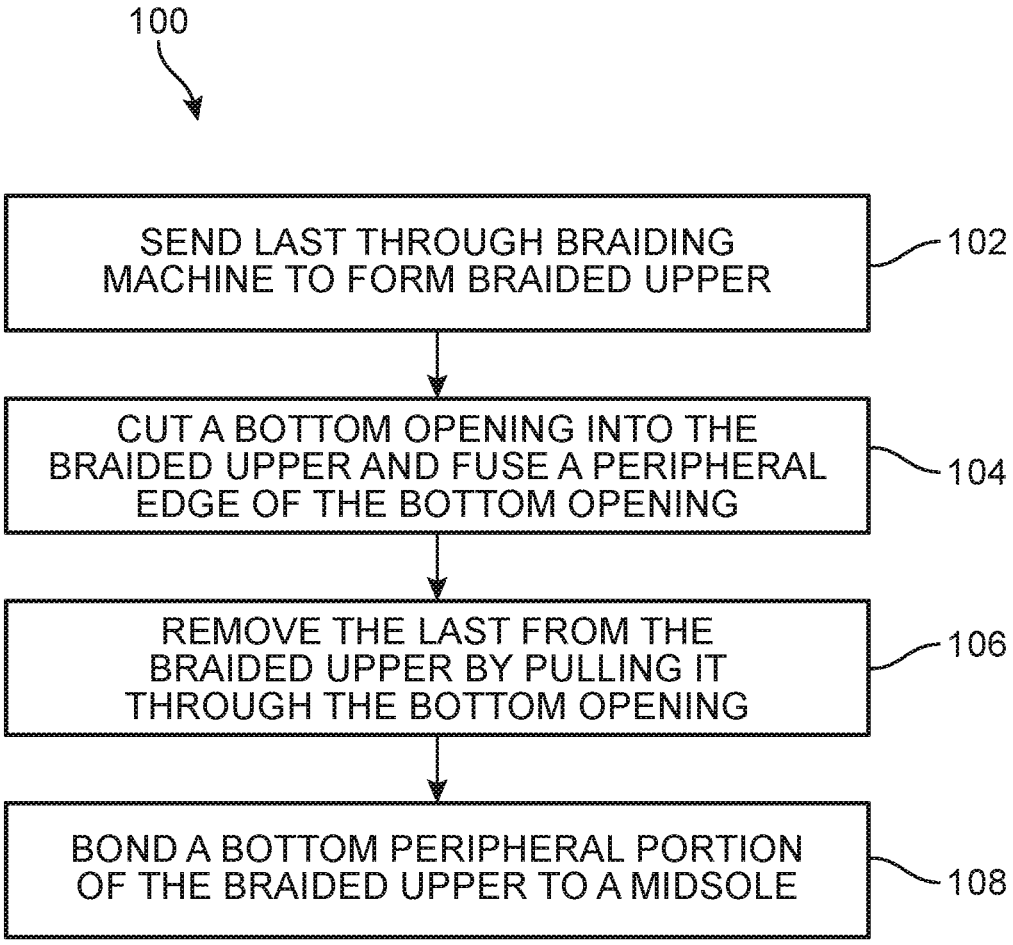
FIG. 1 is a process for making an article of footwear with a braided upper, according to an embodiment.

The embodiments provide a method of making a braided upper and an article of footwear with a braided upper that is continuously bonded with a midsole. The method includes overbraiding strands of material onto a last and then cutting out a bottom portion of the overbraided structure to form the upper. Cutting out the bottom portion provides a sufficiently large opening through which the last can be removed, as typically the top openings of the article (for example, openings at the cuff and lacing region) may be too small to remove the last. Additionally, cutting out the bottom portion provides increased access to the interior of the upper. This increased access makes finishing the article easier. By leaving a bottom peripheral portion on the bottom side of the upper (and surrounding the bottom opening), the upper can be attached directly to a midsole without the need for a board, plate, or other attachment provision. Moreover, the attachment can be continuous, so that the attachment region between the upper and the midsole forms a complete loop with no gaps. This helps reduce the tendency of the upper to separate from the midsole at any locations where the upper and midsole might be unbonded. The embodiments can also include insole components or midsole components that are shaped to fit within the bottom opening of braided upper so that the footbed surface within the braided upper has a relatively smooth shape with no discontinuities.

In the following detailed description, reference is made to the accompanying figures that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicates that the embodiment described may include a particular feature, structure, or characteristic that may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

The terms "comprising," "including," "having," and the like, as used with respect to embodiments of the present disclosure, are synonymous.

The term "fixedly attached" refers to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

FIG. 1 is an example of a process 100 for making an article of footwear with a braided upper, according to one embodiment. In a first step 102, a last may be sent through a braiding machine to form a braided upper. Specifically, the last may be overbraided, so that after passing through the braiding machine, the last is enclosed within the braided upper. Next, in step 104, a bottom opening may be cut, or otherwise removed, from a bottom side of the braided upper. At the same time as the bottom opening is cut into the braided upper, a peripheral edge of the bottom opening may be fused so that the strands of the braided upper do not fray or otherwise separate along the peripheral edge. Optionally, loose strands at the peripheral edge of the bottom opening could be fused after (and separately from) a step of cutting the strands.

In step 106, the last may be removed from the braided upper by pulling the last through the bottom opening. After the last has been removed, the interior cavity of the braided upper may be accessible through the bottom opening. In some cases, stitches, adhesives, reinforcing components, and/or other materials could be applied to the interior of the cavity at this point.

Finally, in step 108, a bottom peripheral portion of the braided upper could be bonded, or otherwise secured, to a midsole. Optionally, in other cases, the braided upper could be lasted and/or a plate could be secured to the braided upper.

Figure 2:
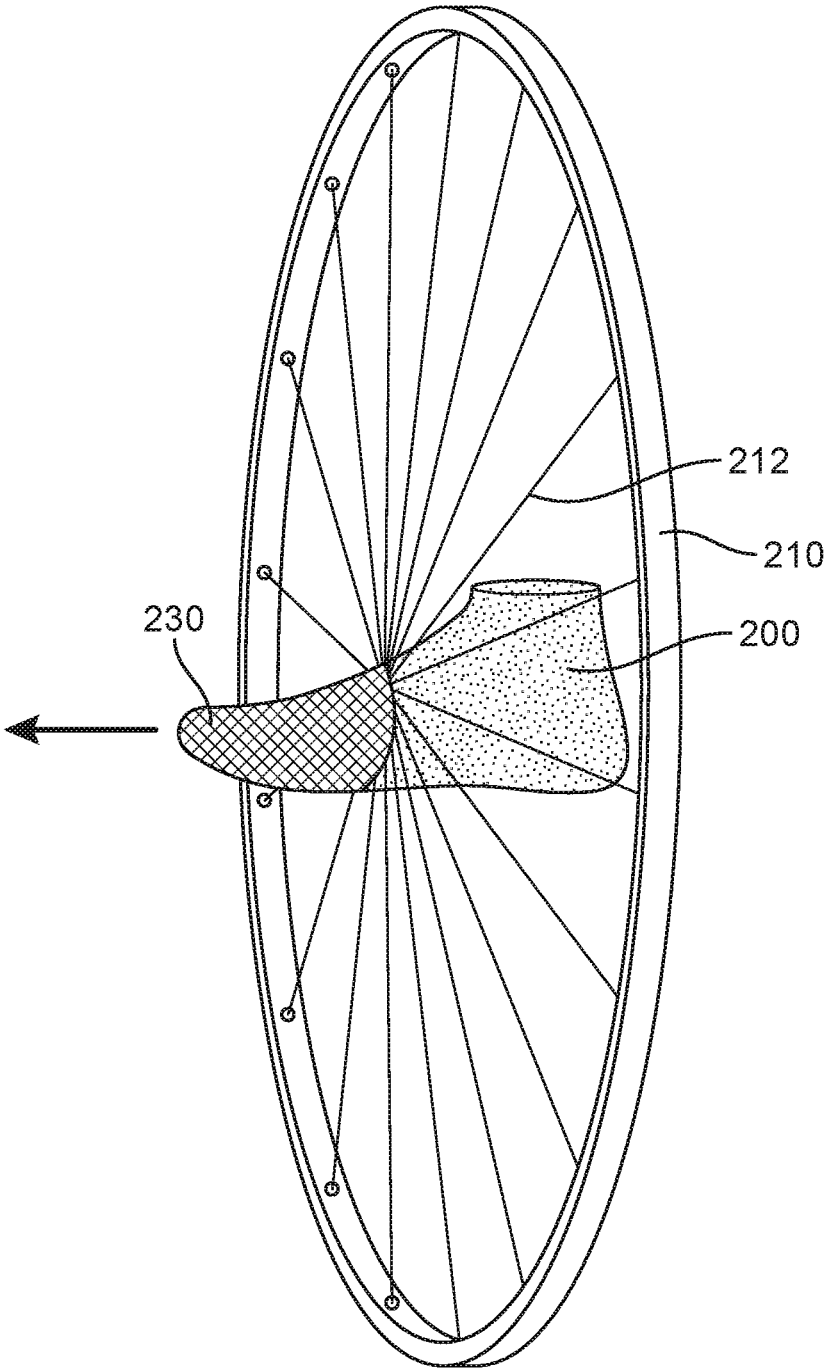
FIG. 2 is a schematic view of a step of overbraiding a last to form a braided upper by passing the last through a braiding machine, according to an embodiment.

FIG. 2 is a schematic view of a step of passing a last 200 through a braiding machine 210 so as to form a braided upper 230, according to an embodiment. Braiding machine 210 includes a plurality of spools (not shown) that include strands of material for forming a braided structure. The term "strand", as used herein, includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.).

To assist in clearly depicting the method used to form an article incorporating a braided component, braiding machine 210 is depicted without spools or a support structure in the following figures. Although depicted without a support structure or spools, it should be recognized that braiding machine 210 as well as other braiding machines depicted in this detailed description may include spools.

The spools pass by one another along a track such that a plurality of strands 212 intertwine and twist with one another. This twisting and intermeshing of plurality of strands 212 forms a braided structure. Although depicted as a radial braiding machine, it should be recognized that an axial braiding machine or other type of braiding machine may be utilized. Further, the braiding machine may also be configured to perform jacquard and non-jacquard motions. An example of a braiding machine is described in Richardson, U.S. Pat. No. 5,257,571, granted Nov. 2, 1993, entitled "Maypole Braider Having a Three Under and Three Over Braiding Path," the entirety of which is hereby incorporated by reference. Additionally, another example of a braiding machine is described in Dow et al., U.S. Pat. No. 7,908,956, granted Mar. 22, 2011, entitled "Machine for Alternating Tubular and Flat Braid Sections," the entirety of which is hereby incorporated by reference.

Braiding machine 210 may be utilized to overbraid an object. "Overbraid" as used herein shall refer to a method of braiding that forms the shape of a three-dimensional structure. An object or structure that is overbraided includes a braided structure that extends around an outer surface of the structure. An object need not be completely covered by a braided structure to be considered overbraided. Rather, an object that is overbraided includes a seamless braided structure that extends around a portion of the object. As an object is overbraided, strands are deposited along an outer surface of the object.

Figure 3:
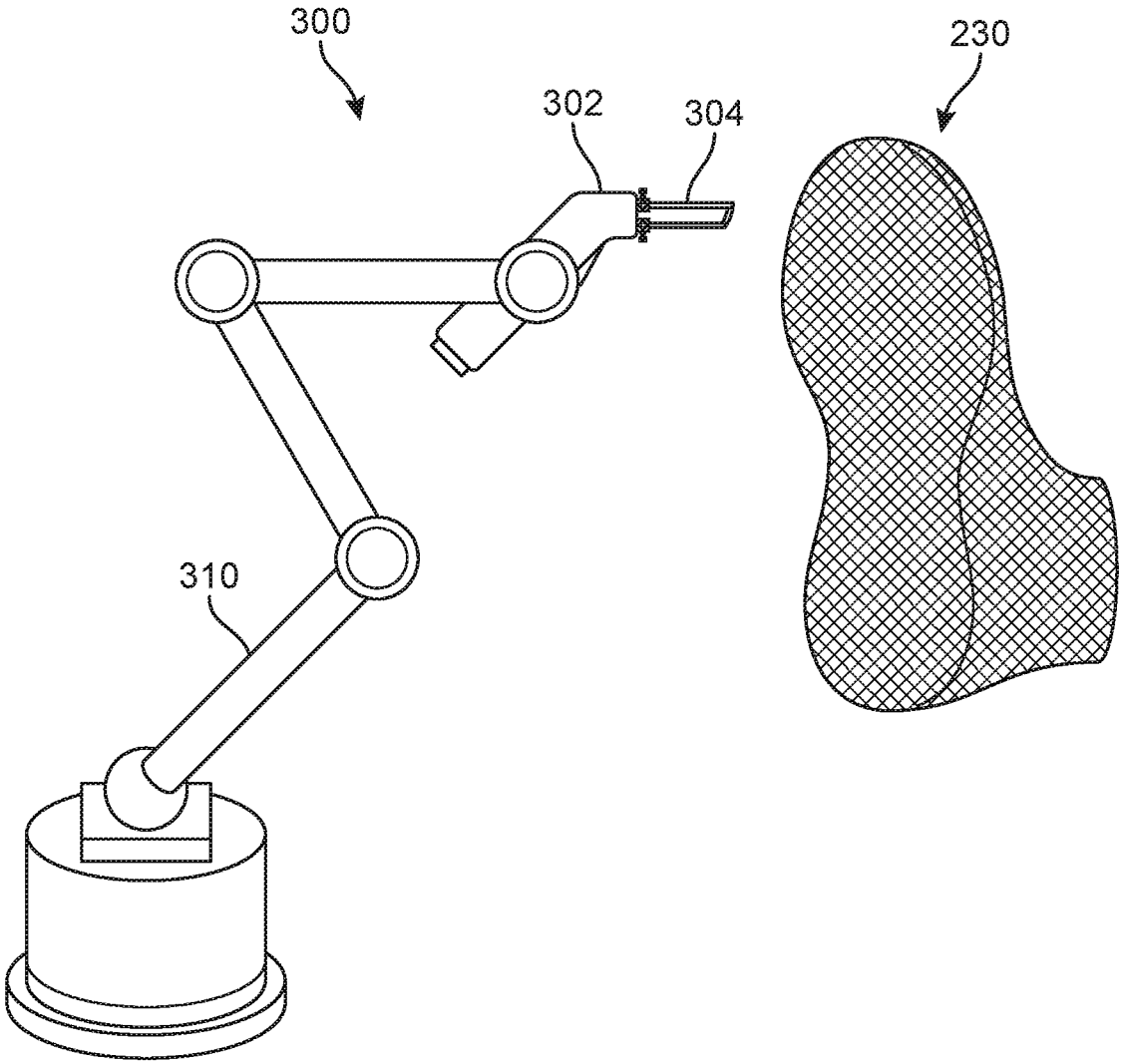
FIG. 3 is a schematic view of a cutting system for removing a bottom portion of a braided upper, where the cutting system comprises a hot-knife controlled by a multi-axis robot, according to an embodiment.

FIG. 3 is a schematic view of an automated cutting system 300. In this example, automated cutting system 300 comprises a hot-knife 302 that is controlled by a multi-axis robot 310. Hot-knife 302 is a tool with a heated blade 304. The three-dimensional position and orientation of hot-knife 302 can be controlled automatically by multi-axis robot 310. Multi-axis robot 310 could be programmed with a predetermined sequence of motions or positions, to facilitate cutting a predetermined pattern from a bottom (or lower) side of braided upper 230. Alternatively, multi-axis robot 310 could incorporate one or more sensors (such as a camera) to sense braided upper 230 in order to cut out a predetermined pattern. Although not shown in FIG. 3, braided upper 230 (and the enclosed last 200) could be supported and held in place using any known apparatus. In an alternative embodiment, the position of the hot-knife could be fixed and the braided upper could be moved using, for example, a multi-axis robot.

Figure 4:
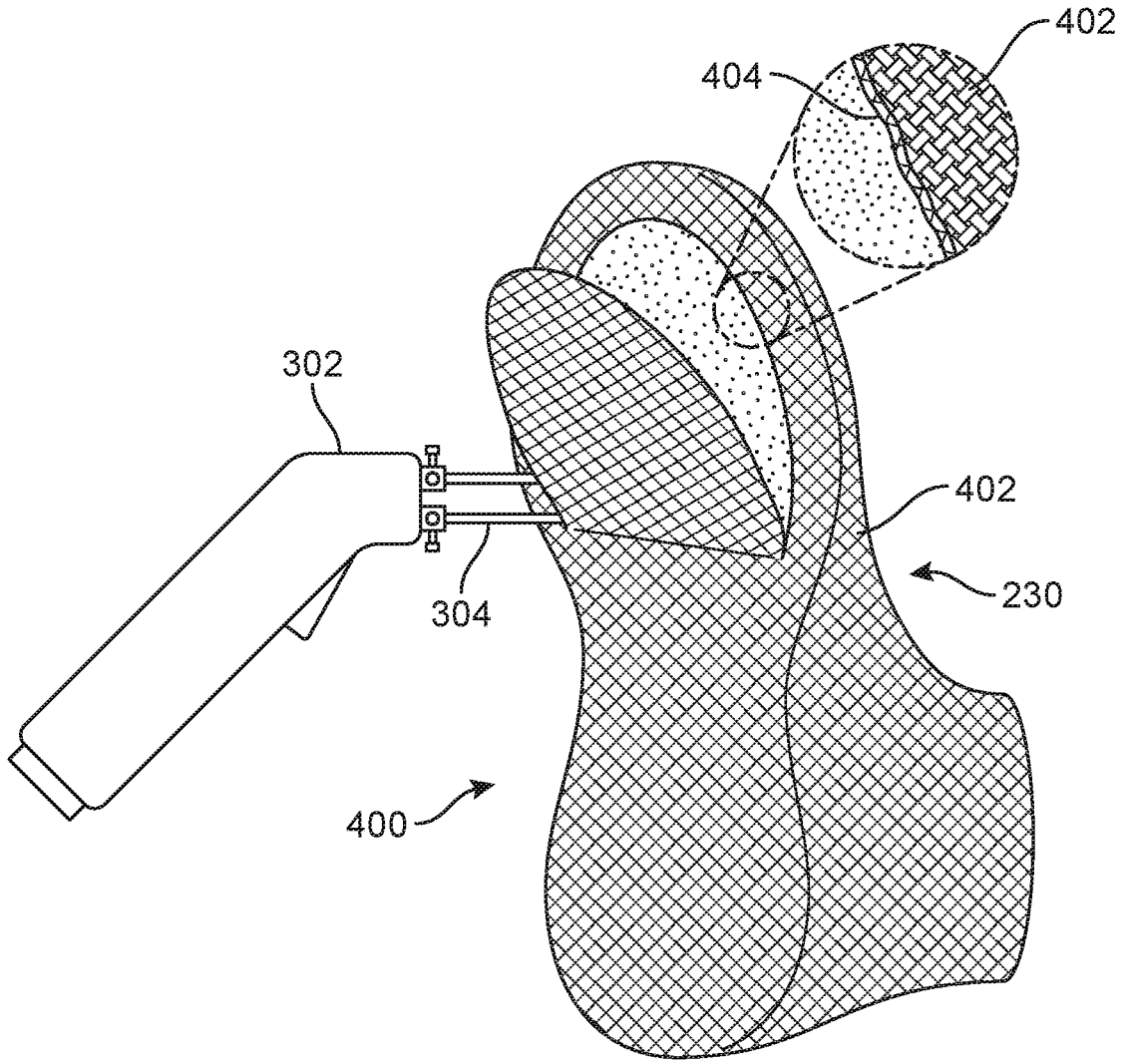
FIG. 4 is a schematic view of a step of cutting the braided upper using the hot-knife of FIG. 3.

Hot-knife 302 may be capable of cutting through one or more layers of the overbraided structure that comprise braided upper 230, as best seen in FIG. 4. Hot-knife 302 may be associated with a bottom side 400 (or lower side) of braided upper 230, so that a bottom portion of braided upper 230 can be removed. Here, bottom side 400 corresponds to the sole side of braided upper 230. As hot-knife 302 comes into contact with braided upper 230, the strands comprising the overbraided structure of braided upper 230 are cut. The cutting may be achieved by a combination of heat and pressure, as blade 304 may be both sharp and extremely hot. Moreover, the heat generated by hot-knife 302 may act to melt the strands 402 of braided upper 230 as they are cut, depending on the type of material comprising strands 402. As strands 402 cool they may form a fused edge 404, as seen in the enlarged view within FIG. 4. This fused edge ensures that the strands of braided upper 230 will not fray or come apart along the bottom side 400 of braided upper 230.

The fusing of strands along the edge of the bottom opening may be facilitated by using thermoplastic materials and/or other hot-melt adhesives. For example, the braided structure could be covered in a thermoplastic layer (such as thermoplastic polyurethane) before or after the braided structure is formed. In another example, the braided strands may be coated with, or made entirely from, a thermoplastic material, such as TPU. As heat is applied by the hot-knife, the thermoplastic material may melt and help form a fused edge that locks the free ends (which have been cut) of the braided structure into place along the bottom opening. Alternatively, other suitable hot-melt materials could be used.

Figure 5:
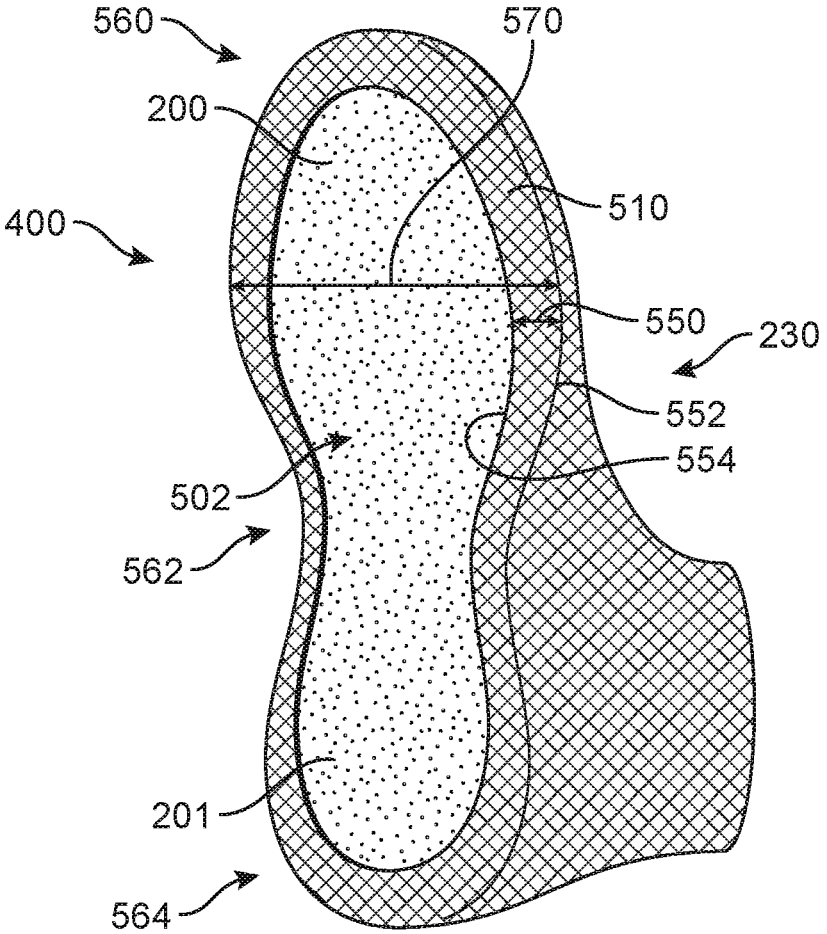
FIG. 5 is a schematic view of a braided upper with a bottom portion removed and with a last disposed within an interior cavity of the braided upper, according to an embodiment.

As seen in FIG. 5, after the cutting is completed, braided upper 230 includes a bottom opening 502 along bottom side 400. Bottom opening 502 may extend through a forefoot portion 560, a midfoot portion 562 and a heel portion 564 of braided upper 230. However, bottom opening 502 does not extend all the way to a lower sidewall edge 552 of braided upper 230. Instead, bottom side 400 still includes a bottom peripheral portion 510 that is disposed on bottom side 400, and which bounds bottom opening 502. Last 200 may be exposed through bottom opening 502. Specifically, a sole surface 201 of last 200 may be exposed through bottom opening 502.

The size of a bottom peripheral portion could vary. In some cases, the size could be selected according to the method used for assembling the braided upper with a midsole, lasting board, plate, or other structure. In the embodiment of FIG. 5, bottom peripheral portion 510 may have a width 550. Width 550 is defined as a distance between a lower-sidewall edge 552 of braided upper 230 and bottom opening edge 554.

The relative size of width 550 can be compared with, for example, a maximum overall width of braided upper 230. In FIG. 5, maximum overall width 570 occurs in a forefoot portion 560 of braided upper 230. Here, the overall width may be taken along a direction extending from a lateral side to a medial side of braided upper 230. The ratio of width 550 to overall width 570 could have a value approximately in the range between 3% and 30%. In one embodiment, the ratio may have a value approximately in the range between 10% to 20%. The particular value of this ratio may be selected to ensure that 1) a bottom opening is large enough for the last to be removed, and 2) sufficient material is available along the bottom or lower side to attach the braided upper to a sole structure or other component.

Figure 6:
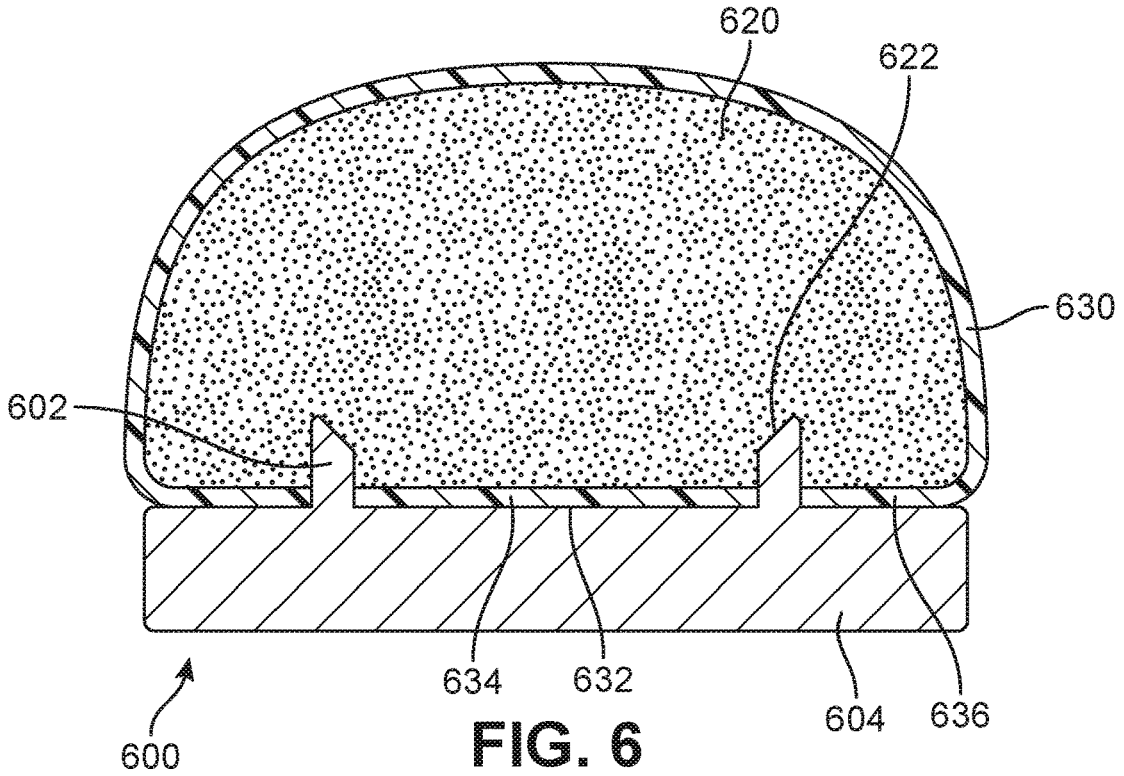
FIG. 6 is a schematic cross-sectional view of another embodiment of a cutting system for removing a bottom portion of a braided upper, in which a cutting plate is used to punch out the bottom portion, according to an embodiment.
Figure 7:
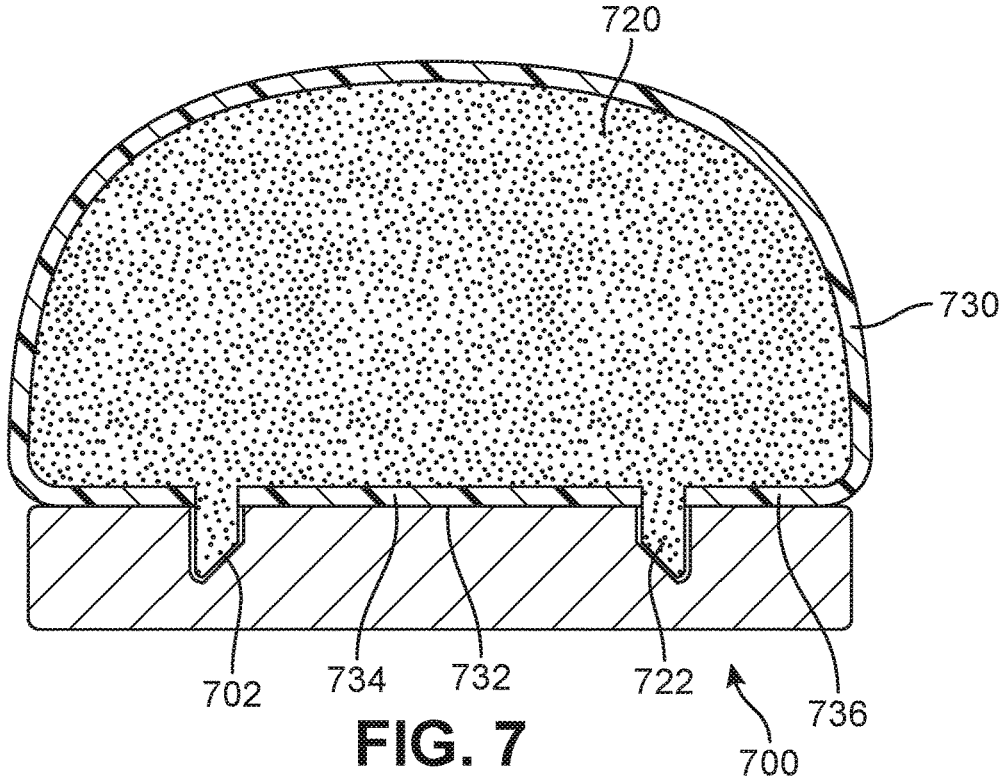
FIG. 7 is a schematic cross-sectional view of another embodiment of a cutting system for removing a bottom portion of a braided upper, in which a cutting portion in the last is used to punch out the bottom portion, according to an embodiment.

FIGS. 6 and 7 depict schematic views of alternative ways of cutting out a bottom opening in a braided upper. In a first example, depicted in the schematic cross-sectional view of FIG. 6, a cutting plate 600 may be pressed against a lower side of a braided upper 630. Cutting plate 600 may include cutting portion 602 that extends up from a base portion 604 of cutting plate 600. Cutting portion 602 may be configured to punch through braided material as cutting plate 600 is pressed against a lower side 632 of braided upper 630. As also seen in FIG. 6, last 620 may incorporate a slot 622 that can receive cutting portion 602. Although depicted in cross-section, it may be appreciated that in some cases, cutting portion 602 may extend in a 2-D path around cutting plate 600 so that cutting portion 602 completely separates an interior bottom portion 634 of braided upper 630 from bottom peripheral portion 636 of braided upper 630.

To facilitate cutting, heat and/or pressure could be applied. If cutting portion 602 is sufficiently sharp, or sufficient pressure is applied, no heat may be necessary. Alternatively, cutting plate 600 could comprise a material that can be heated so that cutting portion 602 can act to melt through strands of braided upper 630. Moreover, heat from the cutting plate could also be used to fuse broken strands to form a fused edge along the periphery of the bottom opening.

FIG. 7 is a schematic view of another embodiment for cutting a bottom opening in a braided upper. In the example of FIG. 7, last 720 may be provided with a cutting portion 722. Cutting portion 722 may be received within a slot 702 of a plate 700. Although depicted in cross-section, it may be appreciated that in some cases, cutting portion 722 may extend in a 2-D path around the bottom side of last 720 so that cutting portion 722 completely separates an interior bottom portion 734 of braided upper 730 from bottom peripheral portion 736 of braided upper 730.

Cutting portion 722 may be configured to punch through braided material as plate 700 is pressed against a lower side 732 of braided upper 730. To facilitate cutting, heat and/or pressure could be applied. If cutting portion 722 is sufficiently sharp, or sufficient pressure is applied, no heat may be necessary. Alternatively, last 720 could comprise a material that can be heated so that cutting portion 722 can act to melt through strands of braided upper 730. Moreover, heat from the last could also be used to fuse broken strands to form a fused edge along the periphery of the bottom opening.

Figure 8:
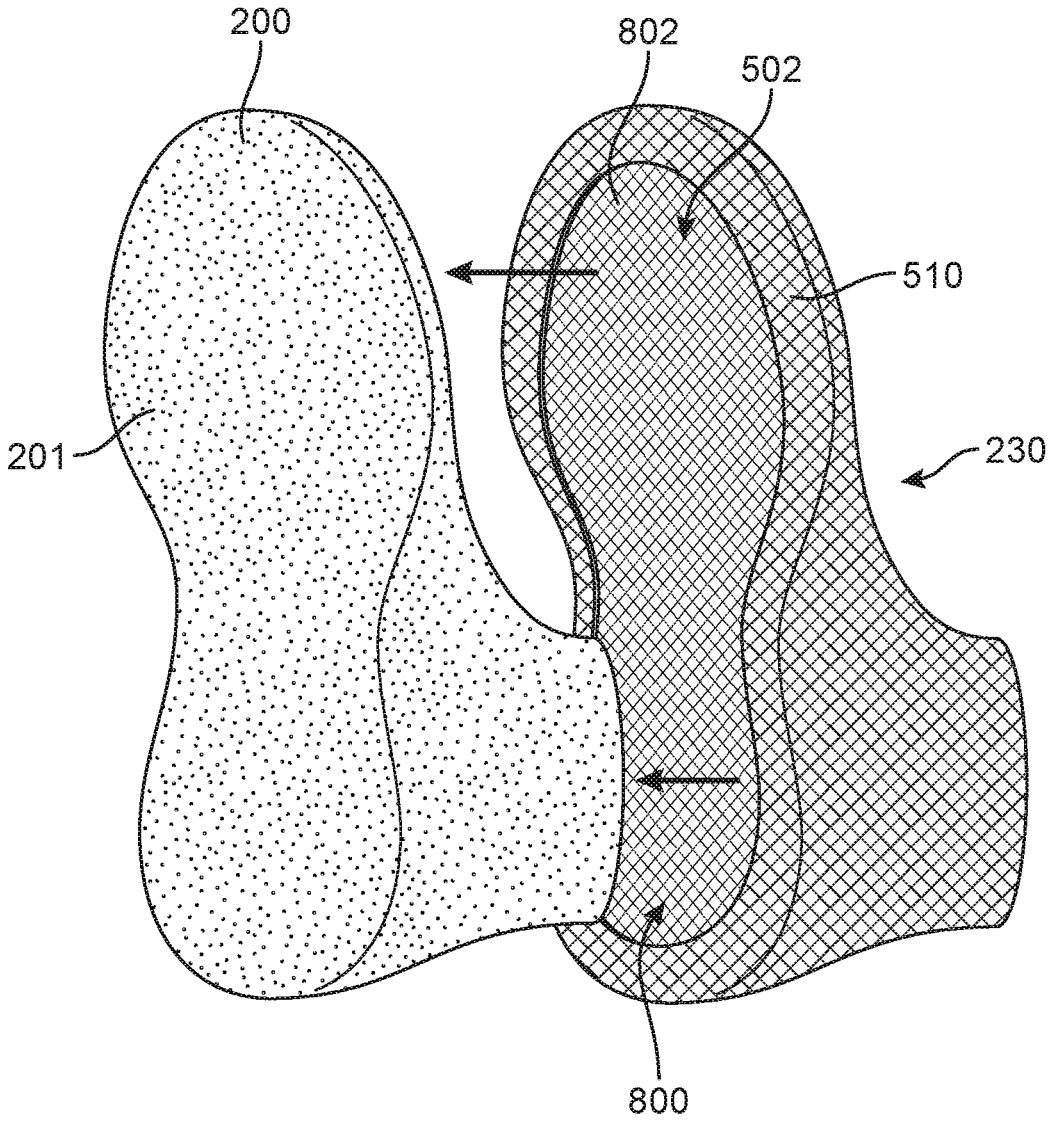
FIG. 8 is a schematic view of a step of removing a last from a braided upper by passing the last through a bottom opening in the braided upper, according to an embodiment.

FIG. 8 is a schematic view of a step of removing last 200 from braided upper 230. Last 200 can be removed manually from braided upper 230. Alternatively, a machine could be used to automatically remove last 200 from braided upper 230. To facilitate grasping a last (using hands or a machine) the last could further incorporate small grasping features, or recesses to receive a removal tool. Such grasping features and/or recesses may be made sufficiently small so as not to interfere with the overbraiding process and/or deform the resulting braided upper.

Bottom opening 502 may have a smaller cross-sectional area than the cross-sectional area of a sole surface 201 of last 200. Thus, it may be necessary to deform bottom peripheral portion 510 to facilitate the removal of last 200 through bottom opening 502. Therefore, braided upper 230 may be made flexible enough to facilitate this deformation of bottom peripheral portion 510.

As clearly seen in FIG. 8, once last 200 has been removed, bottom opening 502 provides access to the internal (or interior) cavity 800 of braider upper 230. The "internal cavity" refers to the space enclosed within the upper and that is occupied by a wearer's foot when the article of footwear is worn. At this point, optional steps to finish the interior of braided upper 230 could be performed. For example, stitches could be applied to the interior surface 802 of interior cavity 800. Other components, such as reinforcing components could also be added. For example, an interior heel counter could be inserted into interior cavity 800 and fixed into place at the heel.

A top opening can be cut out of a braided upper before or after a last is removed. A top opening may comprise a foot-receiving opening. The top opening could include both an opening at the cuff of the upper as well as an opening formed along a lacing region (that is, along an eyestay) of the upper. A top opening could be formed by cutting out material similar to the manner that material is cut out to form the bottom opening. For example, a hot-knife could be used to cut out material and simultaneously from a fused edge along the cuff and fastening area of the upper. However, in cases where the lacing area and cuff may be finished by applying additional layers, the top opening could simply be cut without the need to form a fused edge.

Figure 10:
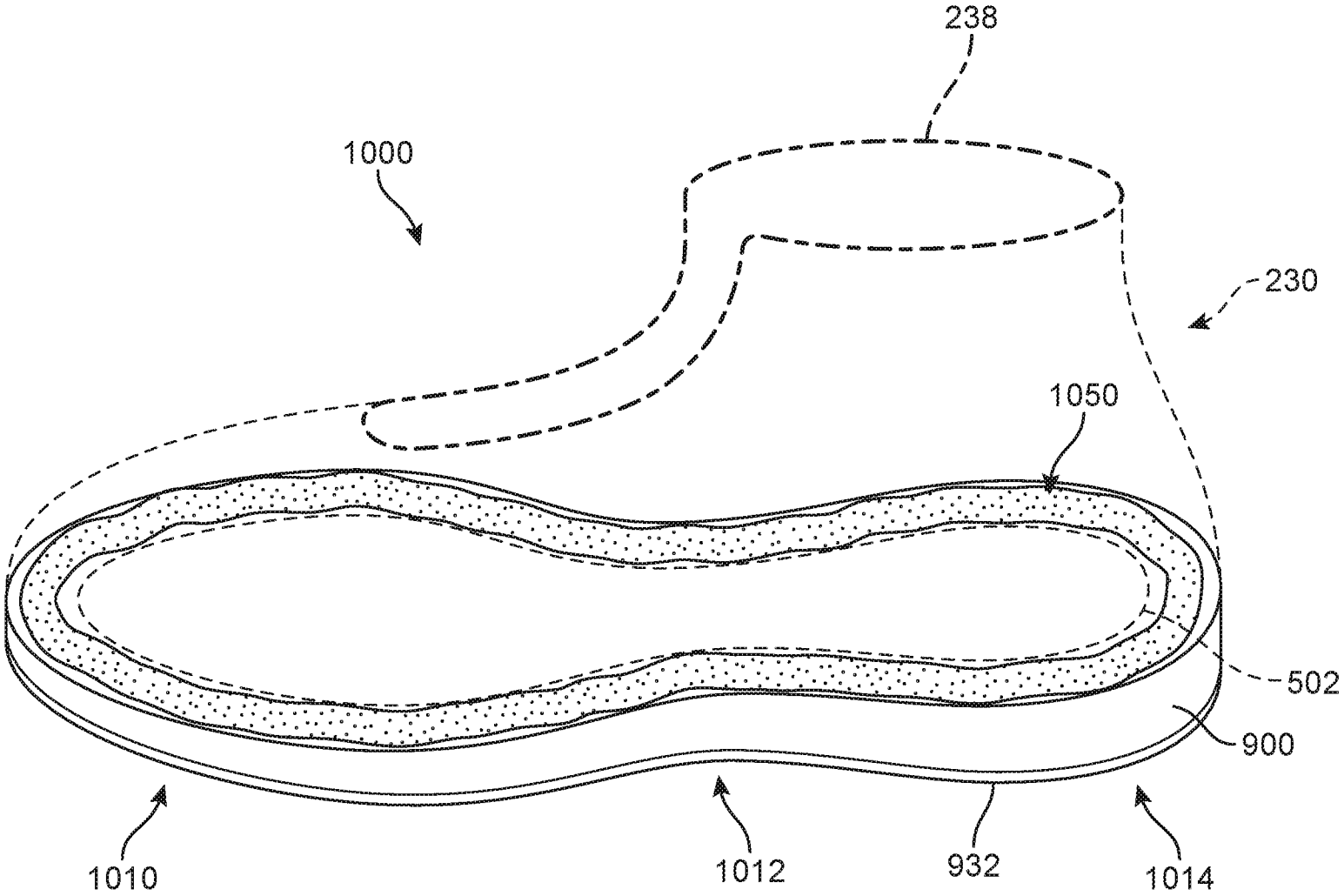
FIG. 10 is a schematic view of an article of footwear with a braided upper, according to an embodiment

Because the overbraided structure is tightly formed around the last, the top opening may be insufficiently large for the last to be removed through the top opening. As an example, FIG. 10 depicts a schematic (phantom) view of braided upper 230. Top opening 238 is depicted along with bottom opening 502. While top opening 238 may be widest along the cuff (in the heel region), top opening 238 may narrow significantly in the lacing region (in the midfoot region) and may be absent in much of the forefoot region adjacent the toes. That is, top opening 238 may have a substantially smaller cross-sectional area than bottom opening 502. Thus, the presence of bottom opening makes it significantly easier to remove a last from the interior cavity of a braided upper than attempting to do so through a top opening.

Figure 9:
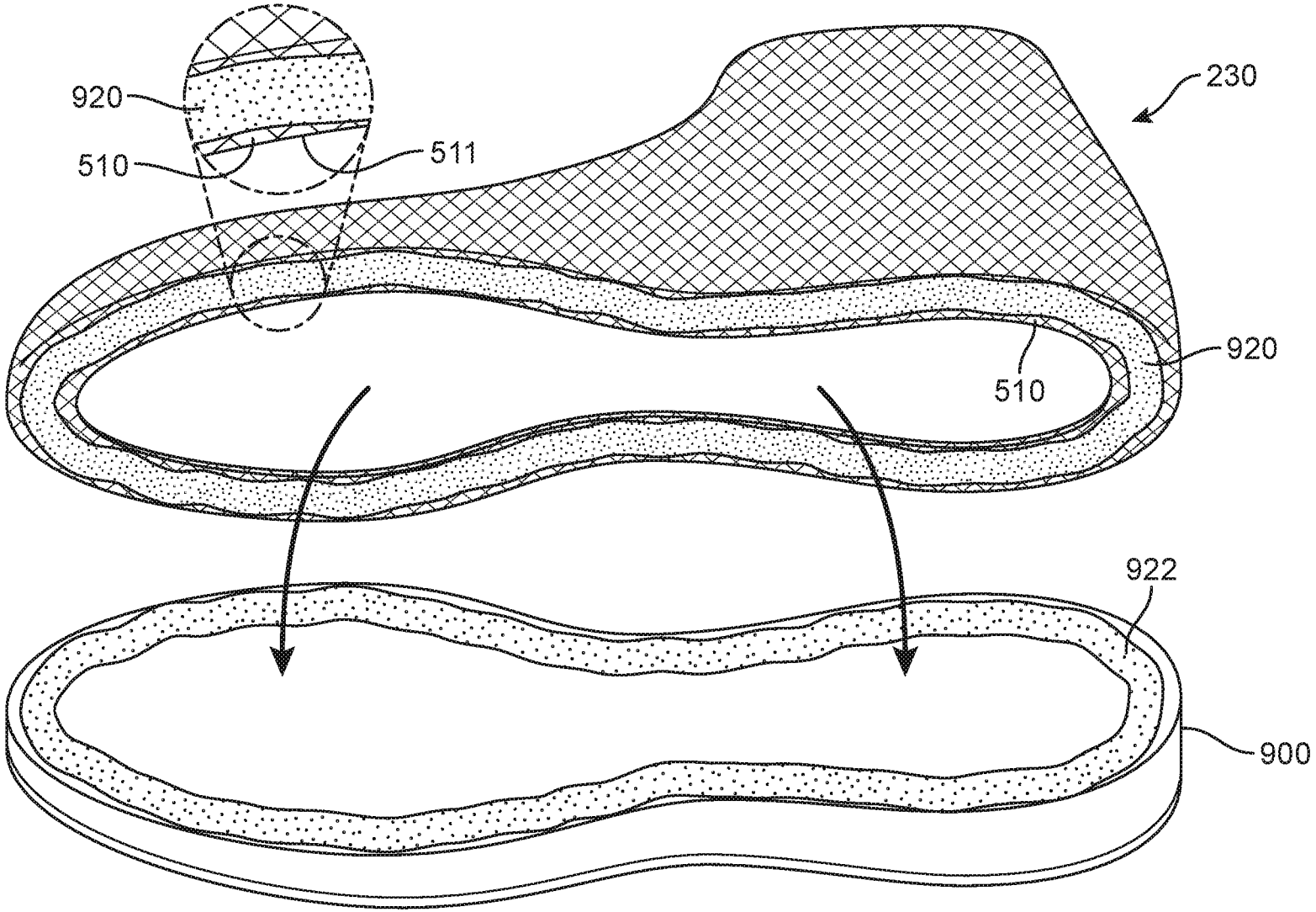
FIG. 9 is a schematic view of a step of associating a braided upper with a midsole, according to an embodiment.

FIGS. 9-10 depict steps of attaching braided upper 230 to a midsole component 900 to form an article of footwear 1000 (see FIG. 10). As seen in FIG. 9, an adhesive 920 could be applied to bottom peripheral portion 510 of braided upper 230. Then, braided upper 230 could be aligned with midsole component 900. Depending on the type of adhesive used, a layer of adhesive 922 could also be applied to midsole component 900. Next, the two pieces could be placed against one another. Heat and/or pressure could also be used to facilitate bonding.

Exemplary adhesives that could be used to bond an upper and midsole include, but are not limited to: contact adhesives, drying adhesives, polymer dispersion adhesives, pressure sensitive adhesives, and hot-melt adhesives. Exemplary contact adhesives include natural rubber and polychloroprene (Neoprene), as these adhesives have high shear resistance. Of course, any suitable adhesive known in the art could be selected. Moreover, the specific adhesive used may be selected according to the specific materials comprising the upper and midsole.

As seen in FIG. 9, bottom peripheral portion 510 also includes a fused edge 511. This fused edge 511 ensures that the braided structure of braided upper 230 doesn't come undone when braided upper 230 is bonded with midsole component 900.

This exemplary process produces an article of footwear 1000, shown in FIG. 10. Article of footwear 1000, or simply article 1000, is comprised of a braided upper 230 and a midsole component 900. Optionally, article 1000 may also include an outsole 932.

For purposes of general reference, as illustrated in FIG. 10, article of footwear 1000 may be divided into three regions: forefoot region 1010, midfoot region 1012, and heel region 1014. Forefoot region 1010 may be generally associated with the toes and joints connecting the metatarsals with the phalanges. Midfoot region 1012 may be generally associated with the arch of a foot, including the instep. Likewise, heel region 1014 or "hindfoot" may be generally associated with the heel of a foot, including the calcaneus bone.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

In the exemplary embodiment depicted in FIG. 10, braided upper 230 comprises a full length upper that extends continuously through all of forefoot region 1010, midfoot region 1012 and heel region 1014. Specifically, braided upper 230 comprises a continuously braided structure extending through each of these regions.

In this exemplary embodiment, braided upper 230 is bonded directly to midsole component 900 without the need for an intermediate lasting board, plate, or other component to facilitate attaching the upper and sole structure. Moreover, the two components are connected by a substantially continuous bonding region 1050. Furthermore, the substantially continuous bonding region forms a closed loop. This configuration ensures that there are no gaps along the boundaries of braided upper 230 and midsole component 900 where these two components are not fixedly attached. This helps reduce the tendency for the midsole to delaminate, while also reducing the tendency for particulate matter (or fluid) to enter the interior cavity through gaps between the upper and midsole.

Though not depicted in FIG. 10, an article could further include an insole. An insole may take the form of a sockliner adjacent the wearer's foot to provide a comfortable contact surface for the wearer's foot. It will be understood that an insole may be optional.

Although not shown in FIG. 10, article 1000 could include various fastening provisions. Examples include, but are not limited to, laces, cables, straps, buttons, zippers as well as any other provisions known in the art for fastening articles. For a lacing system, the fastening region may comprise a plurality of eyelets. In other embodiments, a fastening region may comprise one or more tabs, loops, hooks, b-rings, hollows, or any other suitable fasteners.

Figure 11:
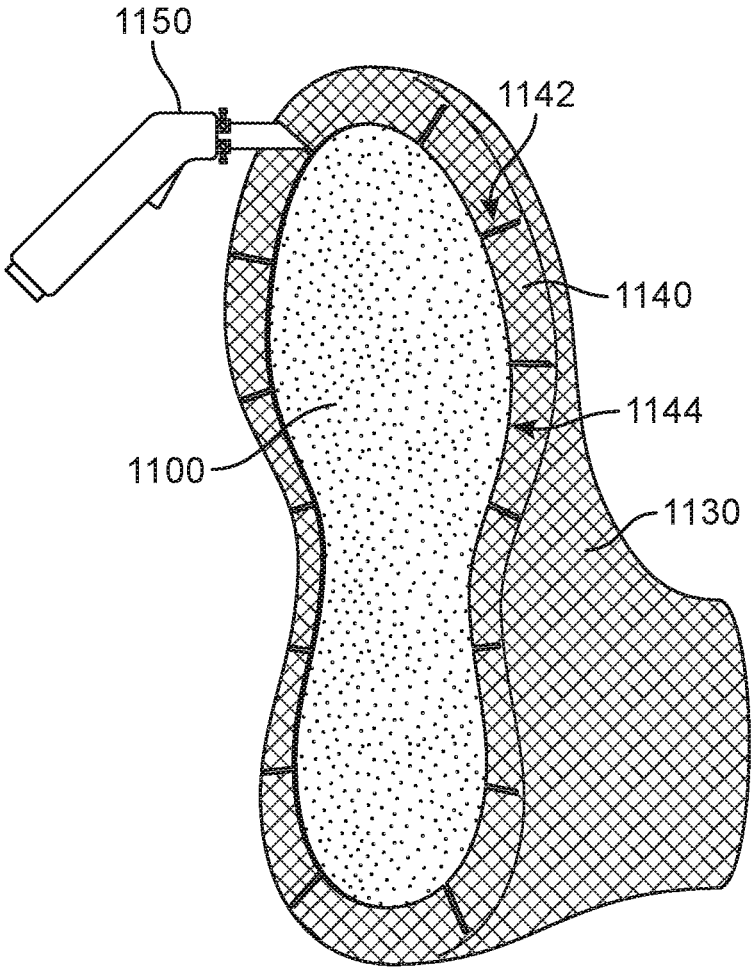
FIG. 11 is a schematic view of a braided upper being cut while on a last, according to an embodiment.
Figure 12:
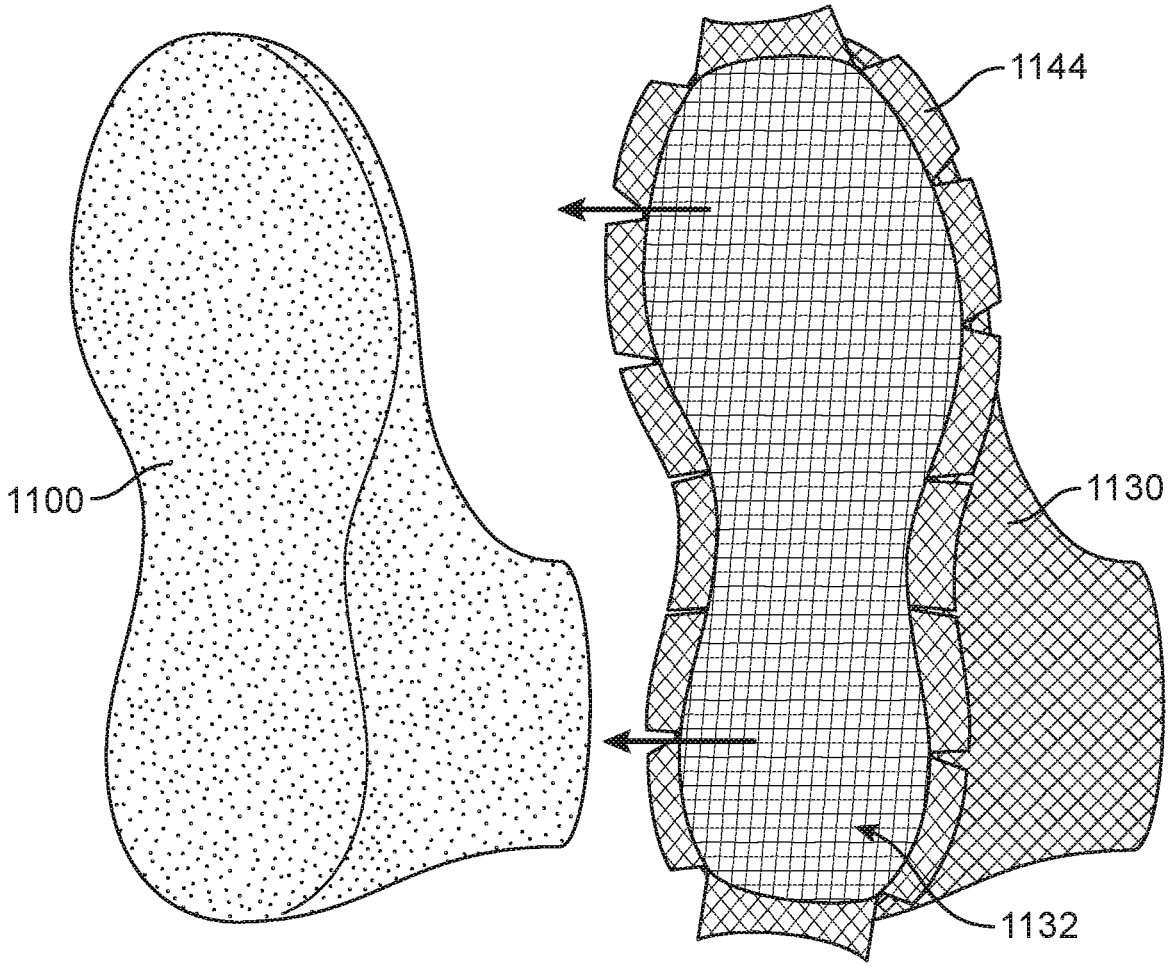
FIG. 12 is a schematic view of the last of FIG. 11 being removed from the braided upper.

It may be appreciated that variations of the method described above and shown in FIGS. 1-10 are possible. As an example, the method could incorporate steps to make it easier to remove a last from a braided upper, especially if the braided upper is relatively rigid and/or non-stretchable. To this end, FIGS. 11 and 12 illustrate schematic views of another embodiment that incorporates a step of cutting the braided upper prior to removing the last. Referring first to FIG. 11, while a last 1100 is still disposed inside of braided upper 1130, cuts or incisions could be made along a bottom peripheral portion 1140 of braided upper 1130. In the example of FIG. 11, cuts 1142 are made in bottom peripheral portion 1140 using a hot-knife 1150. The cuts 1142 may be spaced apart at regular or irregular intervals. The presence of cuts 1142 separates bottom peripheral portion 1140 into a plurality of peripheral tab portions 1144. Moreover, these peripheral tab portions 1144 can flex outwardly (that is, away from an interior cavity of braided upper 1130), as shown in FIG. 12. With peripheral tab portions 1144 flexed outwardly, last 1100 may be more easily removed through a widened bottom opening 1132 of braided upper 1130.

Although the exemplary embodiment depicts the use of a hot-knife to form tab-like portions in a bottom peripheral portion of a braieded upper, cuts could be made using other methods as well. For example, cuts could be made using a laser cutting machine. Alternatively, a last and/or cutting plate (see FIGS. 6 and 7) could incorporate blades that make cuts or notches in the bottom peripheral portion.

In the example shown in FIGS. 9 and 10, a braided upper with a bottom opening is mounted to a sole component with a relatively flat upper surface. If the thickness of the braided upper is not sufficiently thin, there may be a discontinuity in the footbed due to the presence of the bottom peripheral portion along the outer edges of the footbed. To address this issue, some embodiments of a braided article could include structures that fit into the bottom opening and thereby create a relatively smooth footbed surface throughout the entire interior of the upper. As used herein, the term "footbed surface" refers to the entire surface within an upper that is in contact with a sole of the foot during use. The footbed surface may comprise part of a sole component (including insoles and/or midsoles) as well as part of an upper (including a bottom peripheral portion).

Figure 13:
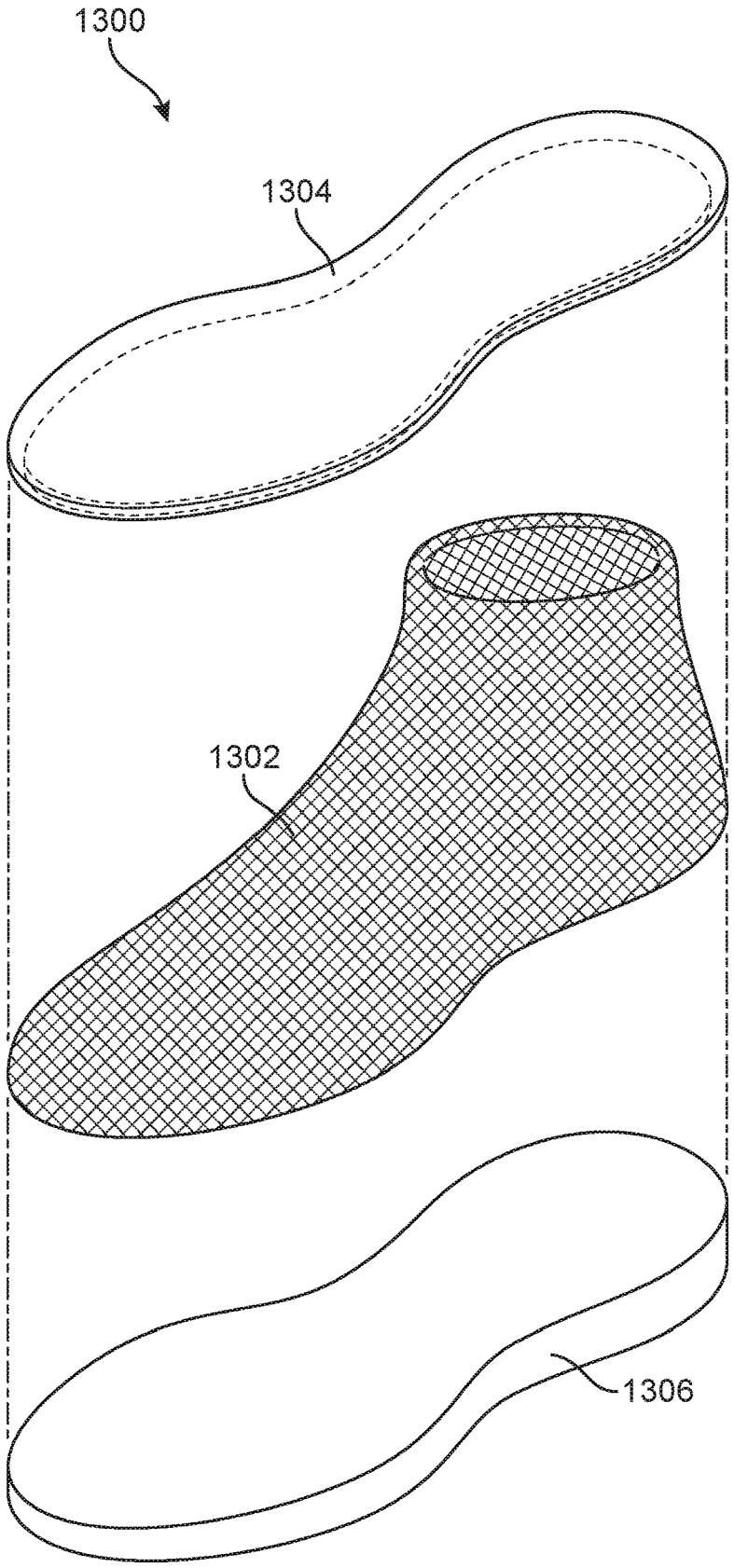
FIG. 13 is a schematic view of one embodiment of an article of footwear with a braided upper, in which an insole component has a projecting portion.
Figure 14:
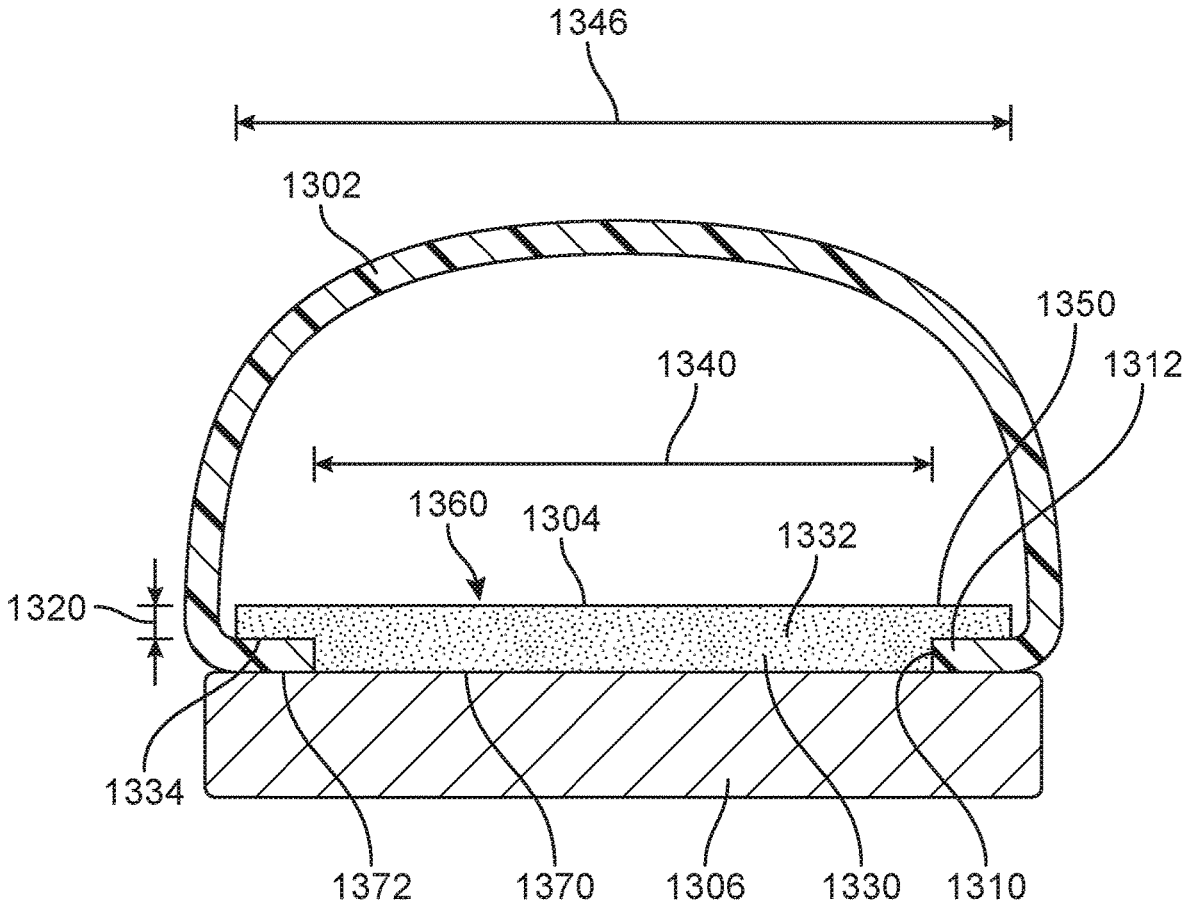
FIG. 14 is a schematic cross-sectional view of the article of footwear of FIG. 13.

FIGS. 13 and 14 are schematic views of one embodiment of a braided article with a substantially smooth footbed surface. Specifically, FIG. 13 is a schematic isometric exploded view of a braided article 1300, while FIG. 14 is a schematic cross-sectional view of braided article 1300.

As seen in FIGS. 13-14, braided article 1300 may include a braided upper 1302, an insole component 1304, and a midsole component 1306. Optionally, braided article 1300 could include an outsole on an outward facing surface of midsole component 1306. For purposes of illustration, braided article 1300 is shown without a distinct outsole component.

Braided upper 1302 may include a bottom opening 1310, the edge of which is indicated schematically in the cross-sectional view shown in FIG. 14. Braided upper 1302 may also include a bottom peripheral portion 1312 that bounds bottom opening 1310. When assembled with midsole component 1306, bottom peripheral portion 1312 creates a discontinuity in the surface at the boundary between midsole component 1306 and braided upper 1302. This discontinuity is due to the nonzero thickness 1320 of bottom peripheral portion 1312.

As also seen in FIGS. 13 and 14, insole component 1304 comprises a bottom projecting portion 1330. Bottom projecting portion 1330 extends downwardly away from a base portion 1332 of insole component 1304. Moreover, bottom projecting portion 1330 has a smaller cross-sectional area (and width) than base portion 1332. Specifically, insole component 1304 has a cross-sectional shape that is configured to mate with bottom opening 1310 of braided upper 1302. As seen in FIG. 14, a width 1340 of bottom projecting portion 1330 is substantianally similar to the width of bottom opening 1310 so that bottom projecting portion 1330 fits within bottom opening 1310. Furthermore, the thickness of bottom projecting portion 1330 (measured relative to the downward surface 1334 of base portion 1332) is substantially similar to the thickness of bottom peripheral portion 1312. Above bottom opening 1310, base portion 1332 of insole component 1304 widens to match the full width 1346 of braided upper 1302. That is, base portion 1332 extends outwardly so a peripheral base portion 1350 covers bottom peripheral portion 1312. This configuration provides a relatively smooth footbed surface 1360 along the upper side of insole component 1304. By contrast, if the insole component had a substantially constant thickness throughout braided upper 1302, part of the insole component might deform down into bottom opening 1310 when a foot is placed inside braided upper 1302, creating a discontinuity in the footbed surface.

As seen in FIG. 14, a lower surface 1370 of insole component 1304 is substantially flush with the lower surface 1372 of bottom peripheral portion 1312. This ensures a relatively smooth surface for contacting and attaching to midsole component 1306.

For purposes of illustration, no adhesives or other means of attachment are depicted in FIG. 14. It may be appreciated that methods of attaching different components of an article could vary. For example, an upper could be stitched to a midsole component along the bottom peripheral portion of the upper. Alternatively, an adhesive could be used to attach the bottom peripheral portion of the upper to a midsole component (for example, the layer of adhesive 922 in FIG. 9). An insole could be further attached using an adhesive. Alternatively, an insole could be selectively stitched to the bottom peripheral portion of the upper. It's also possible that an insole could be secured inside an upper by a frictional fit between a bottom projecting portion and the bottom opening in the upper.

Figure 15:
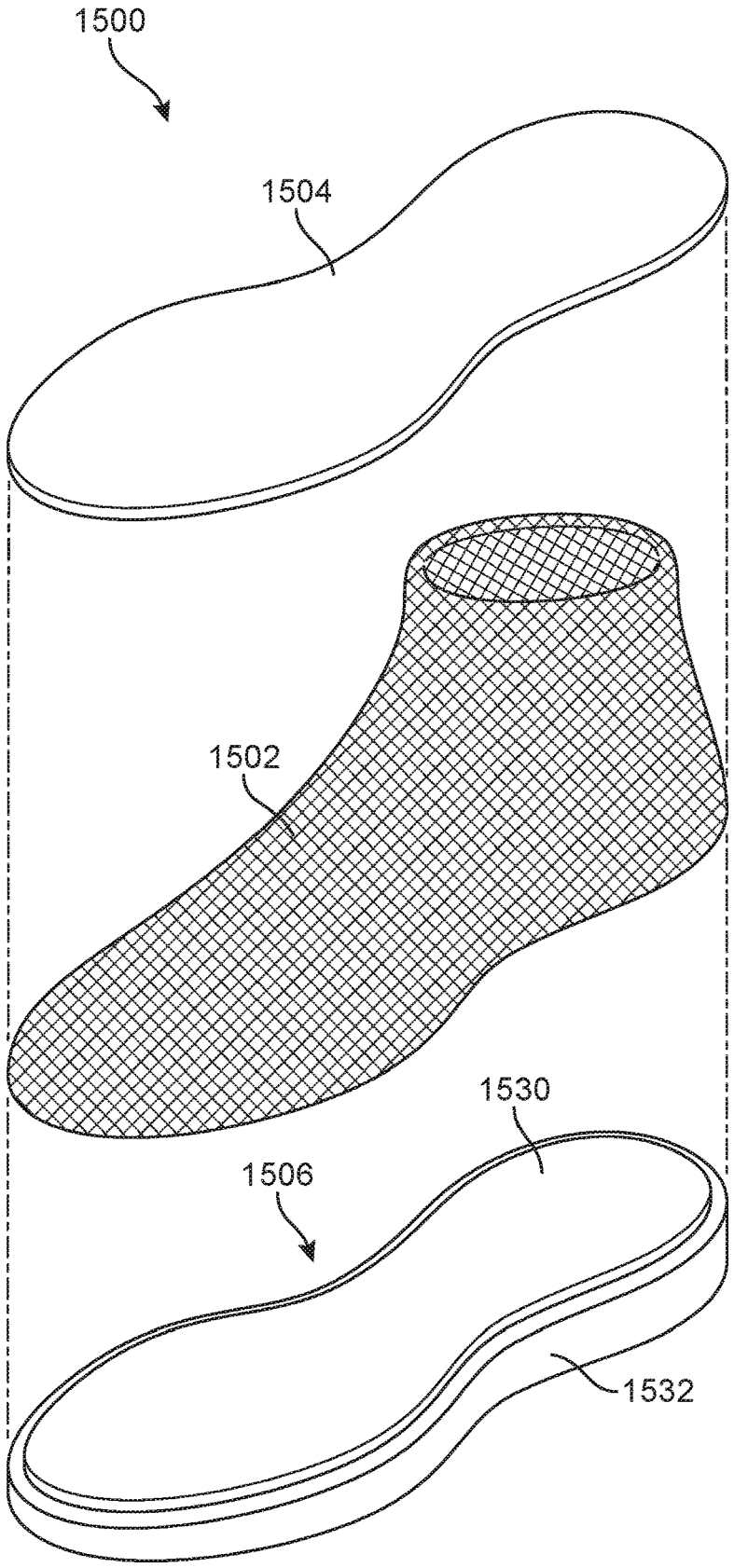
FIG. 15 is a schematic view of one embodiment of an article of footwear with a braided upper, in which a midsole component has a projecting portion.
Figure 16:
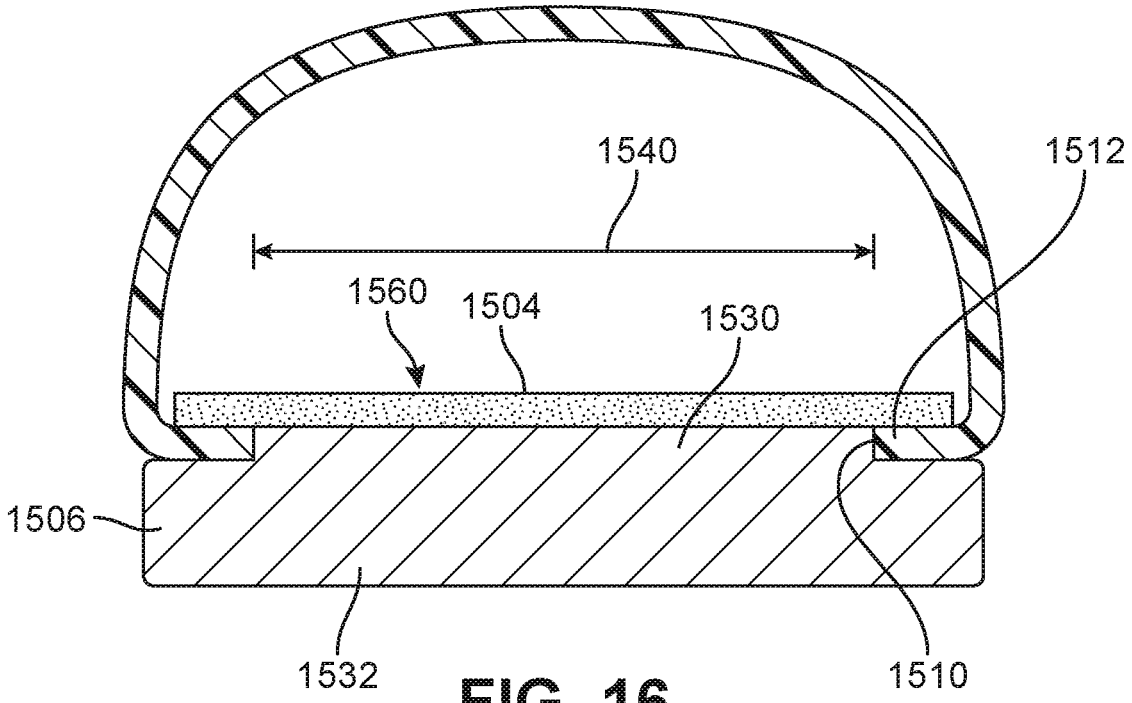
FIG. 16 is a schematic cross-sectional view of the article of footwear of FIG. 15.

FIGS. 15 and 16 are schematic views of one embodiment of a braided article with a substantially smooth footbed surface. Specifically, FIG. 15 is a schematic isometric exploded view of a braided article 1500, while FIG. 16 is a schematic cross-sectional view of braided article 1500.

As seen in FIGS. 15-16, braided article 1500 may include a braided upper 1502, an insole component 1504, and a midsole component 1506. Optionally, braided article 1500 could include an outsole on an outward facing surface of midsole component 1506. For purposes of illustration, braided article 1500 is shown without a distinct outsole component.

Braided upper 1502 may include a bottom opening 1510, the edge of which is indicated schematically in the cross-sectional view shown in FIG. 16. Braided upper 1502 may also include a bottom peripheral portion 1512 that bounds bottom opening 1510.

As also seen in FIGS. 15 and 16, midsole component 1506 comprises an upper projecting portion 1530. Upper projecting portion 1530 extends upwardly away from a base portion 1532 of midsole component 1506. Moreover, upper projecting portion 1530 has a smaller cross-sectional area (and width) than base portion 1532. Specifically, upper projecting portion 1530 has a cross-sectional shape that is configured to mate with bottom opening 1510 of braided upper 1502. As seen in FIG. 16, a width 1540 of upper projecting portion 1530 is substantianally similar to the width of bottom opening 1510 so that upper projecting portion 1530 fits within bottom opening 1510. This configuration provides a relatively smooth footbed surface 1560 along the foot-receiving surface of insole component 1504. By contrast, if the midsole component had a substantially constant thickness throughout the width of article 1500, part of the insole component 1504 might deform down into bottom opening 1510 when a foot is placed inside braided upper 1502, creating a discontinuity in the footbed surface. Alternatively, in another embodiment, article 1500 may not include insole component 1504. However, the footbed surface formed by midsole component 1506 and bottom peripheral portion 1512 may still be substantially smooth without any discontinuities.

Methods of permanently attaching these components can include any of the methods described above with respect to FIGS. 13-14.

Figure 17:
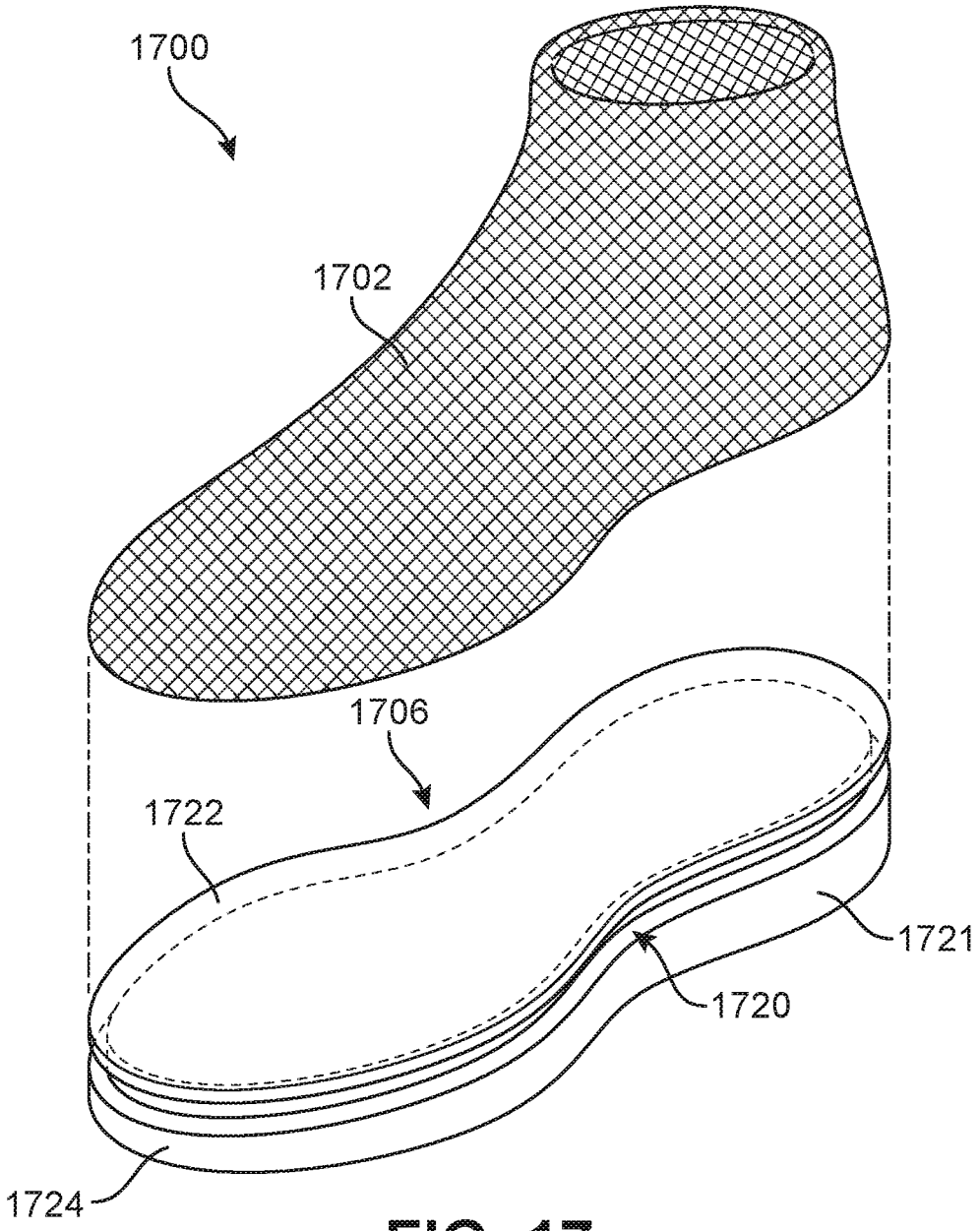
FIG. 17 is a schematic view of one embodiment of an article of footwear with a braided upper, in which a midsole component has a peripheral slot.
Figure 18:
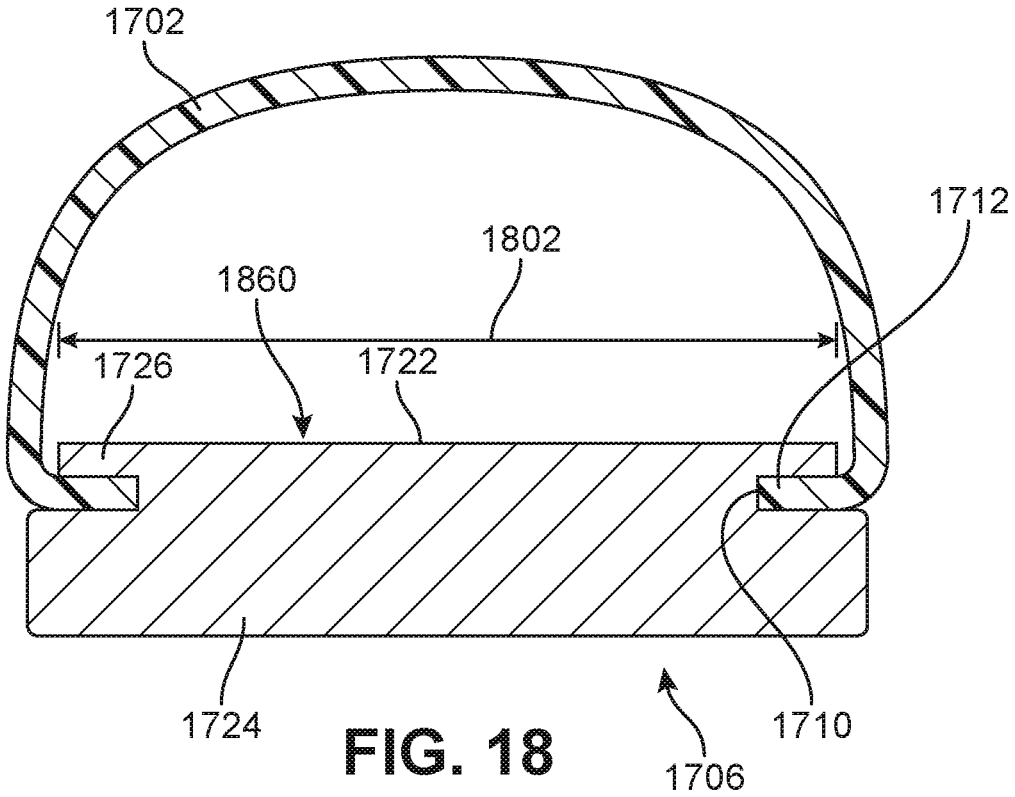
FIG. 18 is a schematic cross-sectional view of the article of footwear of FIG. 17.

FIGS. 17 and 18 are schematic views of one embodiment of a braided article with a substantially smooth footbed surface. Specifically, FIG. 17 is a schematic isometric exploded view of a braided article 1700, while FIG. 18 is a schematic cross-sectional view of braided article 1700.

As seen in FIGS. 17-18, braided article 1700 may include a braided upper 1702 and a midsole component 1706. Optionally, braided article 1700 could include an outsole on an outward facing surface of midsole component 1706. For purposes of illustration, braided article 1700 is shown without a distinct outsole component. Braided upper 1702 may include a bottom opening 1710, the edge of which is indicated schematically in the cross-sectional view shown in FIG. 18. Braided upper 1702 may also include a bottom peripheral portion 1712 that bounds bottom opening 1710.

As also seen in FIGS. 17 and 18, midsole component 1706 comprises a peripheral slot 1720 that extends around the entire peripheray of midsole component 1706. Specifically, peripheral slot 1720 may be disposed in a sidewall 1721 of midsole component 1706. Peripheral slot 1720 separates midsole component 1706 into a lower midsole portion 1724 and an upper midsole portion 1722. As seen in FIG. 18, peripheral slot 1720 (that is, the space between lower midsole portion 1724 and upper midsole portion 1722) may be sized to receive bottom peripheral portion 1712. If peripheral slot 1720 is sufficiently rigid, this may have the effect of locking midsole component 1706 to braided upper 1702, without the need for additional adhesives, stitches, or other fasteners. Optionally, various kinds of adhesives, stitches, or other fasteners could be used to secure parts of midsole component 1706 to braided upper 1702.

As seen in FIG. 18, upper midsole portion 1722 may have a width 1802 that matches the width of braided upper 1702 along the interior lower periphery. In particular, an outer peripheral portion 1726 of upper midsole portion 1722 extends over bottom peripheral portion 1712 of braided upper 1702. This configuration provides a relatively smooth footbed surface 1860 along the upper side of midsole component 1704.

When compared to alternative methods for making an article, the exemplary method facilitates easier insertion of various components into the interior of an upper. Specifically, alternative methods may rely on only the opening at the top of an upper (that is, the foot-receiving opening) for inserting parts. Because of the size and location of this foot-receiving opening, both the insertion and placement of interior components may be difficult. By contrast, the exemplary method allows components to be inserted through bottom opening, which is substantially larger than the opening at the top of the upper that typically receives a foot. This makes it easier to insert components that are substantially wider than the opening at the top of the upper. It also makes it easier to place parts within the interior, since the bottom opening extends along the entire length of the braided upper.

Figure 19:
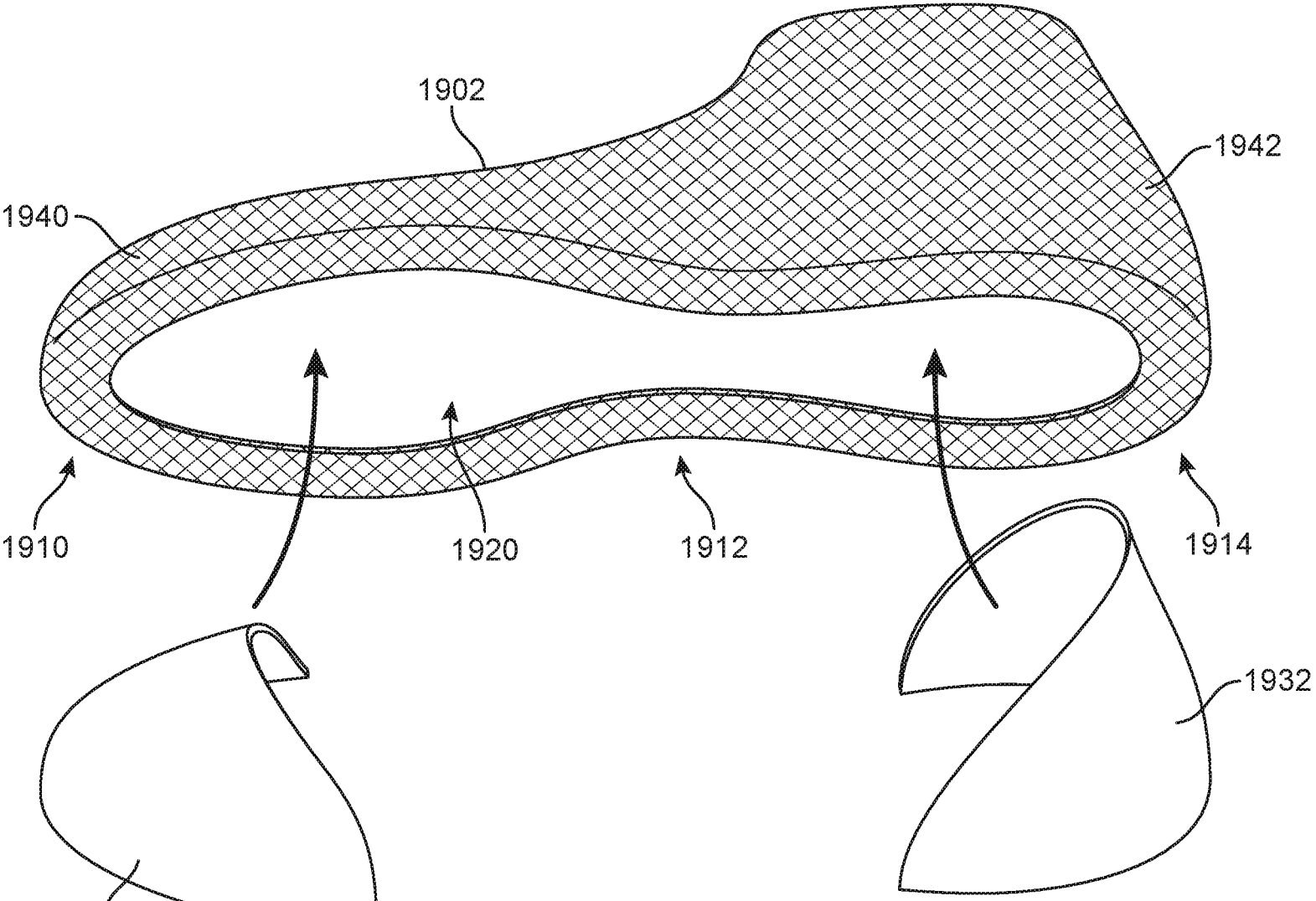
FIG. 19 is a schematic view of an embodiment of a step of inserting internal components into a braided upper through a bottom opening of the braided upper.
Figure 20:
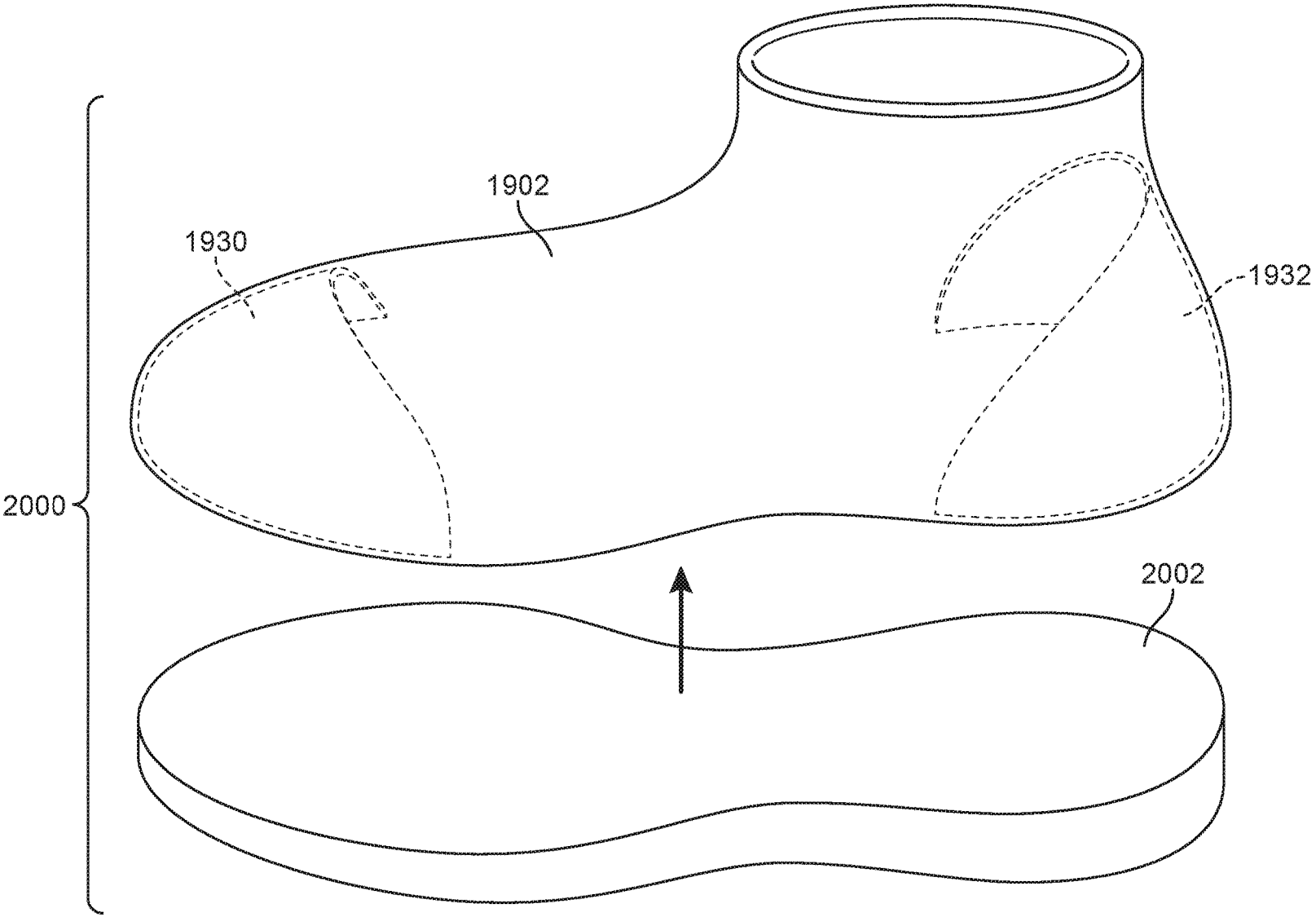
FIG. 20 is a schematic view of a step of assembling a sole component with the braided upper of FIG. 19, once the internal components have been placed inside the braided upper.

As seen in FIG. 19, a braided upper 1902 includes a forefoot region 1910, a midfoot region 1912, and a heel region 1914. Moreover, braided upper 1902 includes a bottom opening 1920 that extends through each of forefoot region 1910, midfoot region 1912, and heel region 1914. In the example shown in FIG. 19, the method of assembling a braided article can include a step of inserting interior components through bottom opening 1920. For example, a toe reinforcing component 1930 can be inserted through bottom opening 1920 at forefoot region 1910. This allows the toe reinforcing component 1930 to be easily placed within toe box portion 1940 of braided upper 1902, as seen in FIGS. 19-20. Likewise, a heel reinforcing component 1932 (such as a heel cup or heel counter) can be easily placed within heel portion 1942 of braided upper 1902, as also seen in FIGS. 19-20. In some cases, these reinforcing components could be further attached to the interior side of braided upper 1902 using adhesives, stitching, and/or other kinds of fasteners. If stitching or other adhesives are used to attach a reinforcing component along an interior of the upper, the present method may make this process easier and more accurate, as the tools for applying stitching or other fasteners can be readily placed through the bottom opening of the braided upper.

With these components in place, a midsole component 2002 can be assembled with braided upper 1902 to form article of footwear 2000, as shown schematically in FIG. 20. For purposes of illustration, midsole component 2002 is shown generically in FIG. 20. However, midsole component may incorporate a raised upper portion (as in FIGS. 15-16) or a peripheral slot (as in FIGS. 17-18) to provide a smooth footbed surface. Alternatively, article 2000 could further include an insole component with a bottom projecting portion (as in FIGS. 13-14).

It may be appreciated that the method described herein can also facilitate incorporating other kinds of internal footwear components beyond a toe reinforcing component and/or a heel reinforcing component. Some uppers may require the use of reinforcing panels at various portions along the upper. For example, some uppers may require the use of a component to reinforce the eyestay region of the upper from within the inside of the upper, as opposed to reinforcing the eyestay by attaching a reinforcing component to the external side of the upper. As another example, the present method may make it easier to add additional embroidered layers and/or knit layers to the interior of the braided upper by accessing the interior of the upper through the bottom opening. Furthermore, internal straps, bands, or other fasteners or tensioning elements could be more easily inserted and attached to interior portions of a braided upper using these same methods.

Figure 21:
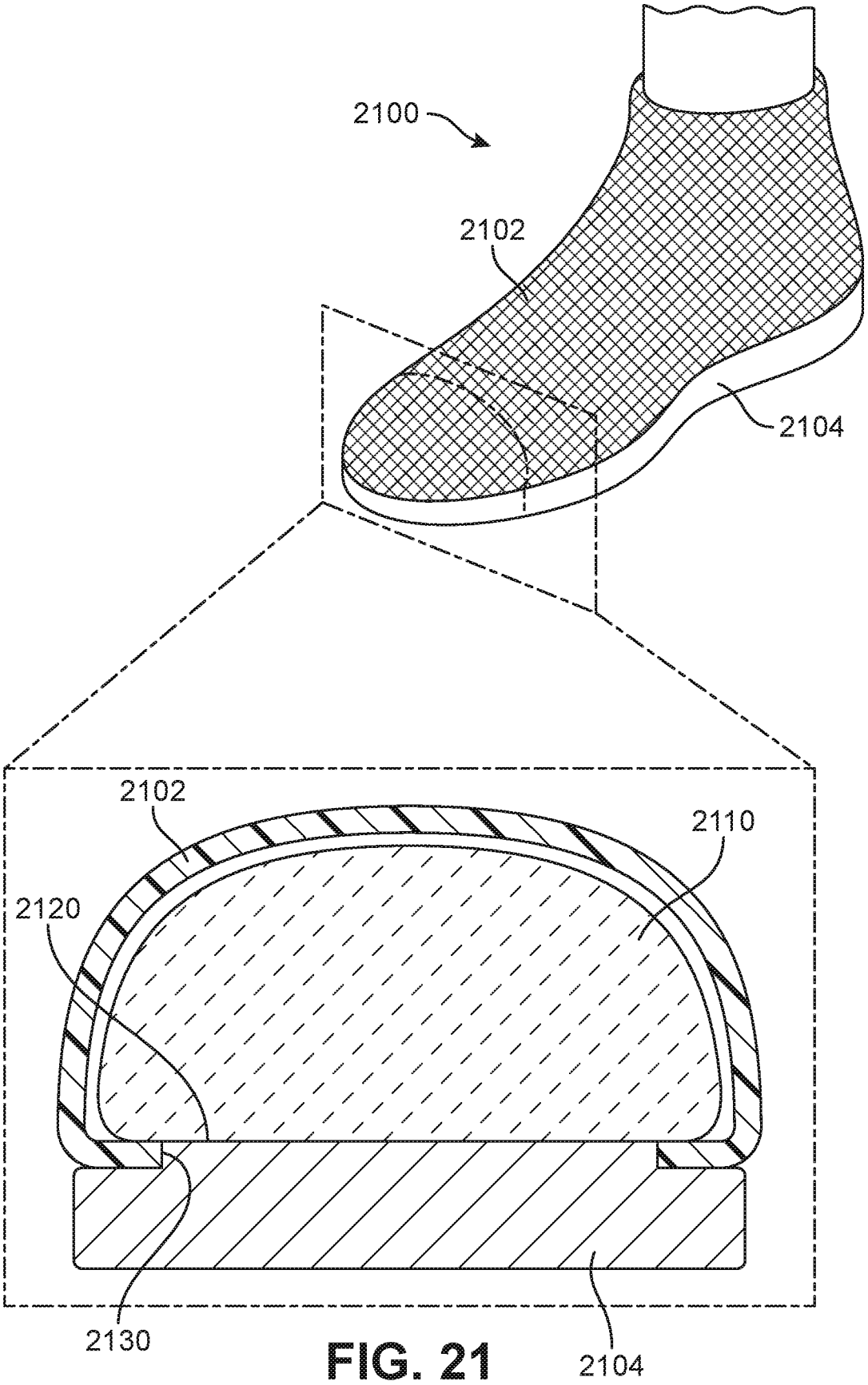
FIG. 21 is a schematic view of an article with a braided upper in which a foot is in contact with an upper side of a midsole component, according to an embodiment.

The exemplary methods produce an article of footwear in which user's foot may come into direct contact with a footbed surface of a sole component, even when there is no insole component used. As an example, FIG. 21 shows a schematic view of an article of footwear 2100 with a braided upper 2102 that has been constructed using the exemplary processes described above. Article 2100 also includes a midsole component 2104.

As shown in FIG. 21, a user's foot 2110 comes into direct contact with an upper surface 2120 of midsole component 2104, which is disposed through a bottom opening 2130 of braided upper 2102. This configuration may improve both cushioning and support compared to other configurations where a relatively rigid material acts to separate the footbed surface from the midsole component. Such a relatively rigid material could be a layer of an upper that closed along the bottom, and/or an adhesive layer. The presence of these layers in some cases may increase the rigidity of the structures between the footbed surface and the outermost surface of the midsole, thereby reducing cushioning and support. By eliminating the need for such structural layers, the present system can improve support and cushioning in an article of footwear.

As described above, a braided upper may be comprised of a plurality of strands. These strands may be formed of different materials. The properties that a particular strand will impart to an area of a braided structure depend on the materials that form the various filaments and fibers within the strands. For example, the filaments may be formed of cotton. Cotton may provide a soft hand, natural aesthetics as well as biodegradability. Other embodiments may include elastane or stretch polyester. In still further embodiments, nylon may be incorporated. Nylon is a durable, abrasion-resistant material with relatively high strength that may be incorporated into areas of an article of footwear that are more likely to be exposed to high stress or scraping than other areas. Polyester may be incorporated due to its hydrophobic nature. For example, a waterproof or water-resistant article may incorporate polyester. Additionally, various materials may be utilized for sweat removal or wicking. The materials chosen may also include properties that permit the material to melt or bond to various components. For example, the materials may include thermoplastic or thermoset materials as well as other heat-activated materials. Additionally, other materials may be utilized for various material properties. In addition to material, other aspects of the strand may be altered to affect the properties of the braided structure. For example, a strand may include monofilament or multifilament thread. The strand may also include separate filaments that are formed of different materials, such as bicomponent strands.

As used herein, the term "article" refers broadly to articles of footwear, articles of apparel (e.g., clothing), as well as accessories and/or equipment. Articles of footwear include, but are not limited to, hiking boots, soccer shoes, football shoes, sneakers, running shoes, cross-training shoes, rugby shoes, basketball shoes, baseball shoes as well as other kinds of shoes. Various kinds of non-sports-related footwear, include, but are not limited to, slippers, sandals, high-heeled footwear, loafers as well as any other kinds of footwear.

Similar principles to those described above could be used with any other kinds of braided articles that may be formed by overbraiding onto a "last" or other form. Specifically, these principles could be applied to various kinds of apparel, accessories, and/or equipment. Examples of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

While various embodiments have been described, the description is intended to be exemplary, rather than limiting, and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A method of making a braided upper, comprising:

passing a last through a braiding machine to form a braided upper that encloses the last, the braided upper including a top opening for receiving a foot;

removing a bottom portion of the braided upper to form a bottom opening, wherein the bottom opening is located on a bottom side of the braided upper opposite the top opening, wherein a portion of the last is exposed through the bottom opening; and passing the last through the bottom opening to remove the last from an interior cavity of the braided upper.

2. The method according to claim 1, wherein removing the bottom portion of the braided upper comprises using a hot-knife to cut through the braided upper.

3. The method according to claim 2, wherein the hot-knife cuts strands of the braided upper and also fuses strands to form a fused peripheral edge along the bottom opening.

4. The method according to claim 1, wherein the last includes a cutting portion, and wherein removing the bottom portion of the braided upper comprises applying pressure to the bottom portion of the braided upper so that the cutting portion cuts through the braided upper to form the bottom opening.

5. The method according to claim 4, wherein removing the bottom portion of the braided upper further includes pressing a plate against the braided upper, the plate including a slot to receive the cutting portion of the last.

6. The method according to claim 1, wherein removing the bottom portion includes pressing a cutting plate against the braided upper, wherein the cutting plate includes a cutting portion, and wherein the cutting portion cuts through the braided upper to form the bottom opening as the cutting plate is pressed against the braided upper.

7. The method according to claim 6, wherein the last includes a slot for receiving the cutting portion of the cutting plate.

8. A method of making an article of footwear, comprising:

passing a last through a braiding machine to form a braided upper that encloses the last;

removing a bottom portion of the braided upper to form a bottom opening, wherein a portion of the last is exposed through the bottom opening, and wherein the braided upper includes a bottom peripheral portion extending around the bottom opening;

passing the last through the bottom opening to remove the last from an interior cavity of the braided upper;

associating a midsole with the braided upper, the midsole having an upper surface; and bonding the bottom peripheral portion to the upper surface of the midsole.

9. The method according to claim 8, wherein removing the bottom portion of the braided upper comprises using a hot-knife to cut through the braided upper.

10. The method according to claim 9, wherein the hot-knife cuts strands of the braided upper and also fuses strands to form a fused peripheral edge along the bottom opening.

11. The method according to claim 8, wherein bonding the bottom peripheral portion to the upper surface of the midsole includes applying a bonding agent to the bottom peripheral portion of the braided upper.

12. The method according to claim 8, wherein bonding the bottom peripheral portion to the upper surface of the midsole includes applying a bonding agent to the upper surface of the midsole.

13. The method according to claim 8, wherein bonding the bottom peripheral portion to the upper surface of the midsole includes applying a bonding agent to the bottom peripheral portion of the braided upper and applying the bonding agent to the upper surface of the midsole.

14. The method according to claim 8, wherein the method further includes a step of removing a top portion of the braided upper to form a top opening.

15. The method according to claim 14, wherein the top opening has a smaller cross-sectional area than the bottom opening.

16. The method according to claim 14, wherein the top opening is too small for the last to be passed through the top opening.

17. A method of making an upper for an article of footwear, comprising:

passing a last through a braiding machine to form a braided upper that encloses the last;

removing a bottom portion of the braided upper to form a bottom opening, wherein a portion of the last is exposed through the bottom opening, and wherein the braided upper includes a bottom peripheral portion extending around the bottom opening;

passing the last through the bottom opening to remove the last from an interior cavity of the braided upper; and inserting a reinforcing component through the bottom opening and placing the reinforcing component within an interior cavity of the braided upper.

18. The method according to claim 17, wherein the method further includes attaching the reinforcing component to an interior surface of the braided upper.

19. The method according to claim 17, wherein the reinforcing component is disposed in a heel region of the braided upper.

20. The method according to claim 17, wherein the reinforcing component is disposed in a forefoot region of the braided upper.

* * * * *